US011525208B2

(12) United States Patent
Song et al.

(10) Patent No.: US 11,525,208 B2
(45) Date of Patent: Dec. 13, 2022

(54) CLOTHES TREATMENT APPARATUS AND CONTROL METHOD THEREOF

(71) Applicant: Samsung Electronics Co., Ltd., Suwon-si (KR)

(72) Inventors: Inbang Song, Suwon-si (KR); Hyeonuk Na, Suwon-si (KR); Kyoungmin Park, Suwon-si (KR); Jaebok Lee, Suwon-si (KR); Hojin Lee, Suwon-si (KR); Seokho Ju, Suwon-si (KR); Sangyeon Pyo, Suwon-si (KR); Yeonsoo Ham, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 20 days.

(21) Appl. No.: 17/100,485

(22) Filed: Nov. 20, 2020

(65) Prior Publication Data

US 2021/0156075 A1 May 27, 2021

(30) Foreign Application Priority Data

Nov. 21, 2019 (KR) ..... 10-2019-0150583

(51) Int. Cl.
*D06F 71/34* (2006.01)
*D06F 71/04* (2006.01)
(Continued)

(52) U.S. Cl.
CPC ..... *D06F 71/34* (2013.01); *D06F 34/30* (2020.02); *D06F 58/10* (2013.01); *D06F 58/203* (2013.01);
(Continued)

(58) Field of Classification Search
CPC ..... D06F 71/34; D06F 71/04; D06F 71/29; D06F 71/40; D06F 34/30; D06F 58/44; D06F 58/10; D06F 58/203; D06F 58/26
(Continued)

(56) References Cited

U.S. PATENT DOCUMENTS 2,811,293 A * 10/1957 Holm ..... A47G 25/90 211/1
5,305,484 A 4/1994 Fitzpatrick et al.
(Continued)

FOREIGN PATENT DOCUMENTS

CN 208748389 U * 4/2019
JP 10314500 A * 12/1998
(Continued)

OTHER PUBLICATIONS

International Search Report and Written Opinion of the International Searching Authority in connection with International Application No. PCT/KR2020/015937 dated Feb. 22, 2021, 18 pages.

*Primary Examiner* — Ismael Izaguirre

(57) ABSTRACT

A clothes treatment apparatus includes a cabinet; an inner door disposed to be rotatable in a front surface of the cabinet and provided with an opening; an outer door disposed to form a space in which clothes are mounted between a front surface of the inner door and the outer door, the outer door disposed to rotate with respect to the cabinet together with the inner door or with respect to the inner door separately from the inner door; a heating plate disposed on a rear surface of the outer door; a holding device disposed in an upper portion of the space between the inner door and the outer door and formed to hold one end of the clothes; and a pair of clips disposed under the holding device in the space between the inner door and the outer door and formed to hold both sides of the clothes.

20 Claims, 27 Drawing Sheets

(51) Int. Cl.

| | |
|---|---|
| ***D06F 71/29*** | (2006.01) |
| ***D06F 71/40*** | (2006.01) |
| ***D06F 34/30*** | (2020.01) |
| ***D06F 58/44*** | (2020.01) |
| ***D06F 58/10*** | (2006.01) |
| ***D06F 58/26*** | (2006.01) |
| ***D06F 58/20*** | (2006.01) |

(52) U.S. Cl.
CPC ..... *D06F 58/26* (2013.01); *D06F 58/44* (2020.02); *D06F 71/04* (2013.01); *D06F 71/29* (2013.01); *D06F 71/40* (2013.01)

(58) Field of Classification Search
USPC ..... D32/25
See application file for complete search history.

(56) References Cited

U.S. PATENT DOCUMENTS

| | | | | |
|---|---|---|---|---|
| 7,017,786 | B2 | 3/2006 | Ho | |
| 9,309,618 | B2 | 4/2016 | Park et al. | |
| 11,168,438 | B2 | 11/2021 | Kim et al. | |
| 2004/0237356 | A1* | 12/2004 | Khasianovich | A47G 25/72 38/69 |
| 2005/0150918 | A1 | 7/2005 | Ho | |
| 2011/0005276 | A1 | 1/2011 | Moon et al. | |
| 2015/0159315 | A1* | 6/2015 | Lim | D06F 71/29 38/3 |
| 2018/0148887 | A1 | 5/2018 | Choi et al. | |
| 2019/0211497 | A1 | 7/2019 | Kim et al. | |
| 2019/0330791 | A1* | 10/2019 | Nam | D06F 58/10 |
| 2019/0368117 | A1 | 12/2019 | Kim et al. | |
| 2021/0054560 | A1 | 2/2021 | Kim et al. | |
| 2021/0310181 | A1 | 10/2021 | Park | |

FOREIGN PATENT DOCUMENTS

| | | | |
|---|---|---|---|
| KR | 20-0347471 | Y1 | 4/2004 |
| KR | 10-2008-0065752 | A | 7/2008 |
| KR | 10-2011-0048343 | A | 5/2011 |
| KR | 10-2015-0009718 | A | 1/2015 |
| KR | 10-2018-0052955 | A | 5/2018 |
| KR | 10-2018-0136806 | A | 12/2018 |
| KR | 10-2019-0018143 | A | 2/2019 |
| KR | 10-1988323 | B1 | 6/2019 |
| KR | 10-2019-0110290 | A | 9/2019 |
| KR | 10-2019-0116093 | A | 10/2019 |
| KR | 10-2021-0019865 | A | 2/2021 |
| WO | WO 20191944567 | A1 * | 10/2019 |

* cited by examiner

CLOTHES TREATMENT APPARATUS AND CONTROL METHOD THEREOF

CROSS-REFERENCE TO RELATED APPLICATIONS

This application is based on and claims priority under 35 U.S.C. § 119 to Korean Patent Application No. 10-2019-0150583 filed on Nov. 21, 2019 in the Korean Intellectual Property Office, the disclosure of which is incorporated by reference herein in its entirety.

BACKGROUND

1. Field

The disclosure relates to a clothes treatment apparatus for improving a condition of clothes and a control method thereof.

2. Description of the Related Art

Generally, a washing machine is widely used as a device for washing articles made of fabrics such as clothes or bedding. The washing machine is configured to wash laundry by friction between the laundry and washing water contained in the water tub. Therefore, in addition to the washing process, processes such as a dehydrating process, a drying process, and the like are additionally required.

Recently, as an apparatus that treats or manages clothes more simply than such a washing machine, clothes treatment apparatuses having a function of removing winkles, dust, or odor from clothes without a separate washing process through washing water are used.

A conventional clothes treatment apparatus removes fine dust and wrinkles from clothes by supplying high-temperature steam to the clothes and transmitting a mechanical force to the clothes through strong airflow or vibration.

However, the conventional clothes treatment apparatus has a problem in that it is difficult to maintain the original crease of the clothes.

In addition, the conventional clothes treatment apparatus has a problem in that it is difficult to unfold wrinkles in special portions of the clothes such as collars, cuffs, button portions, and the like.

SUMMARY

The disclosure has been developed in order to overcome the above drawbacks and other problems associated with the conventional arrangement. An aspect of the disclosure relates to a clothes treatment apparatus capable of sharpening creases inherent in clothes and a control method thereof.

Another aspect of the disclosure relates to a clothes treatment apparatus capable of unfolding wrinkles in special portions of clothes such as collars, cuffs, button portions, and the like and a control method thereof.

According to an aspect of the disclosure, a clothes treatment apparatus may include a cabinet; an inner door disposed to be rotatable in a front surface of the cabinet and provided with an opening; an outer door disposed to form a space in which clothes are mounted between a front surface of the inner door and the outer door, the outer door disposed to rotate with respect to the cabinet together with the inner door or with respect to the inner door separately from the inner door; a heating plate disposed on a rear surface of the outer door; a holding device disposed in an upper portion of the space between the inner door and the outer door and formed to hold one end of the clothes; and a pair of clips disposed under the holding device in the space between the inner door and the outer door and formed to hold both sides of the clothes.

The holding device may include a base plate disposed on the front surface of the inner door; a pressing plate hinged to be pivotable with respect to the base plate and configured to apply a force toward the front surface of the inner door and a heating member disposed on an inner surface of the pressing plate.

The holding device may include a pedal disposed in a lower portion of the inner door and formed to rotate the pressing plate, and wherein when a force is applied to the pedal, the pressing plate may rotate in a direction away from the inner door, and when the force applied to the pedal is removed, the pressing plate may apply a predetermined force toward the inner door.

The holding device may include a pressing member disposed between the base plate and the pressing plate and configured to press the pressing plate toward the inner door; a motor disposed on one side of the pressing plate and configured to rotate the pressing plate in a direction spaced apart from the inner door; and a foot switch disposed in a lower portion of the inner door and configured to turn on/off the motor.

According to another aspect of the disclosure, a control method of a clothes treatment apparatus may include mounting clothes in a space between an inner door and an outer door of the clothes treatment apparatus; and performing ironing on the clothes, by the clothes treatment apparatus, wherein the performing ironing on the clothes may include generating steam by operating an injection device and supplying the steam to the clothes; generating heat by a heating plate of the outer door; and drying the clothes by operating a circulation device.

According to another aspect of the disclosure, a control method of a clothes treatment apparatus may include selecting a special ironing in the clothes treatment apparatus; opening an outer door of the clothes treatment apparatus; checking a position of a holding device disposed in an inner door and adjusting the position of the holding device; pressing a pedal or a foot switch so that a pressing plate of the holding device is opened; setting a special portion of clothes in the holding device; releasing the pedal or the foot switch; applying force and heat to the special portion of the clothes by the holding device; and pressing the pedal or the foot switch and removing the clothes from the holding device.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 25, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, certain embodiments of a clothes treatment apparatus according to the disclosure and a control method thereof will be described in detail with reference to the accompanying drawings.

Various embodiments of the disclosure will hereinafter be described with reference to the accompanying drawings. However, it is to be understood that technologies mentioned in the disclosure are not limited to specific embodiments, but include various modifications, equivalents, and/or alternatives according to embodiments of the disclosure. The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the present disclosure, a first component may be referred to as a second component, and similarly, a second component may also be referred to as a first component.

The terms used in embodiments of the present disclosure may be construed as commonly known to those skilled in the art unless otherwise defined.

Further, the terms 'leading end', 'rear end', 'upper side', 'lower side', 'top end', 'bottom end', etc. used in the present disclosure are defined with reference to the drawings. However, the shape and position of each component are not limited by the terms.

Figure 1:
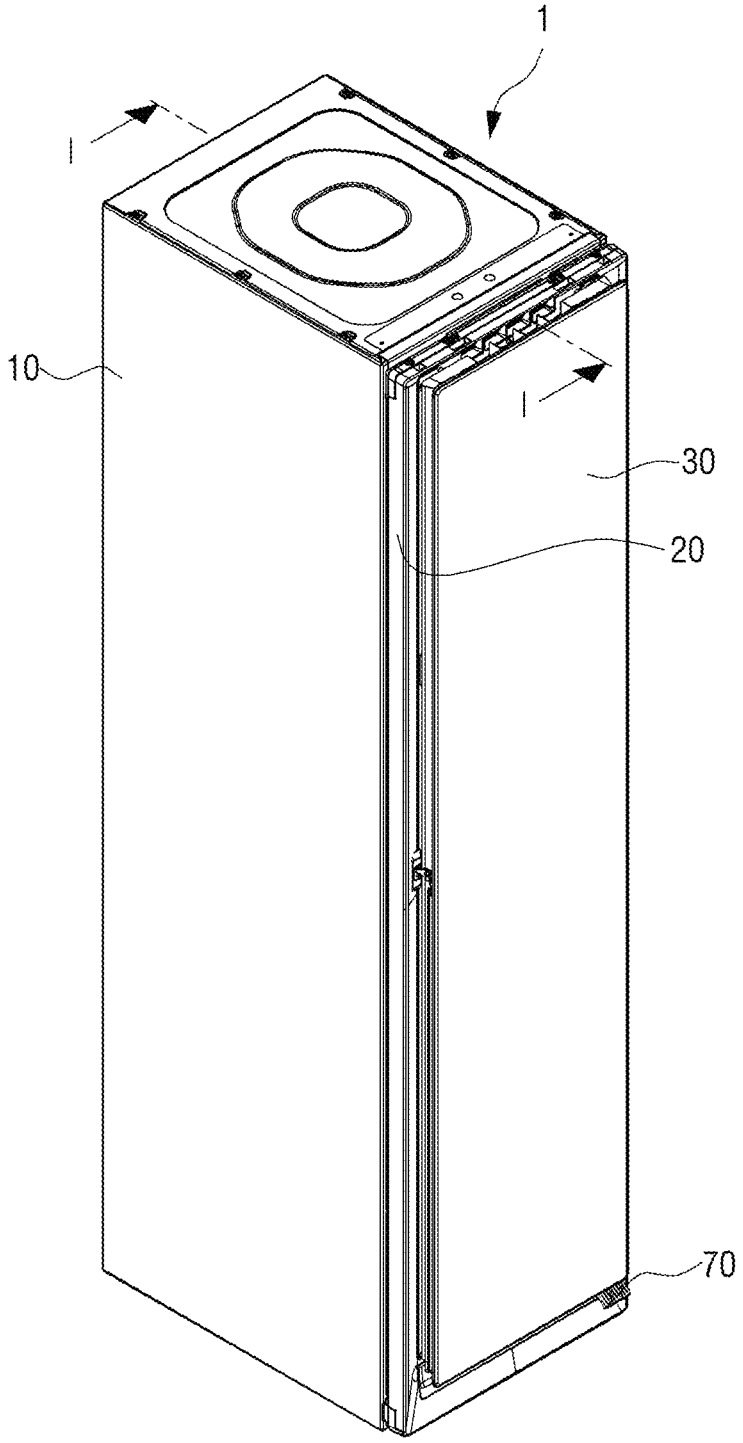
FIG. 1 is a perspective view illustrating a clothes treatment apparatus according to an embodiment.
Figure 2:
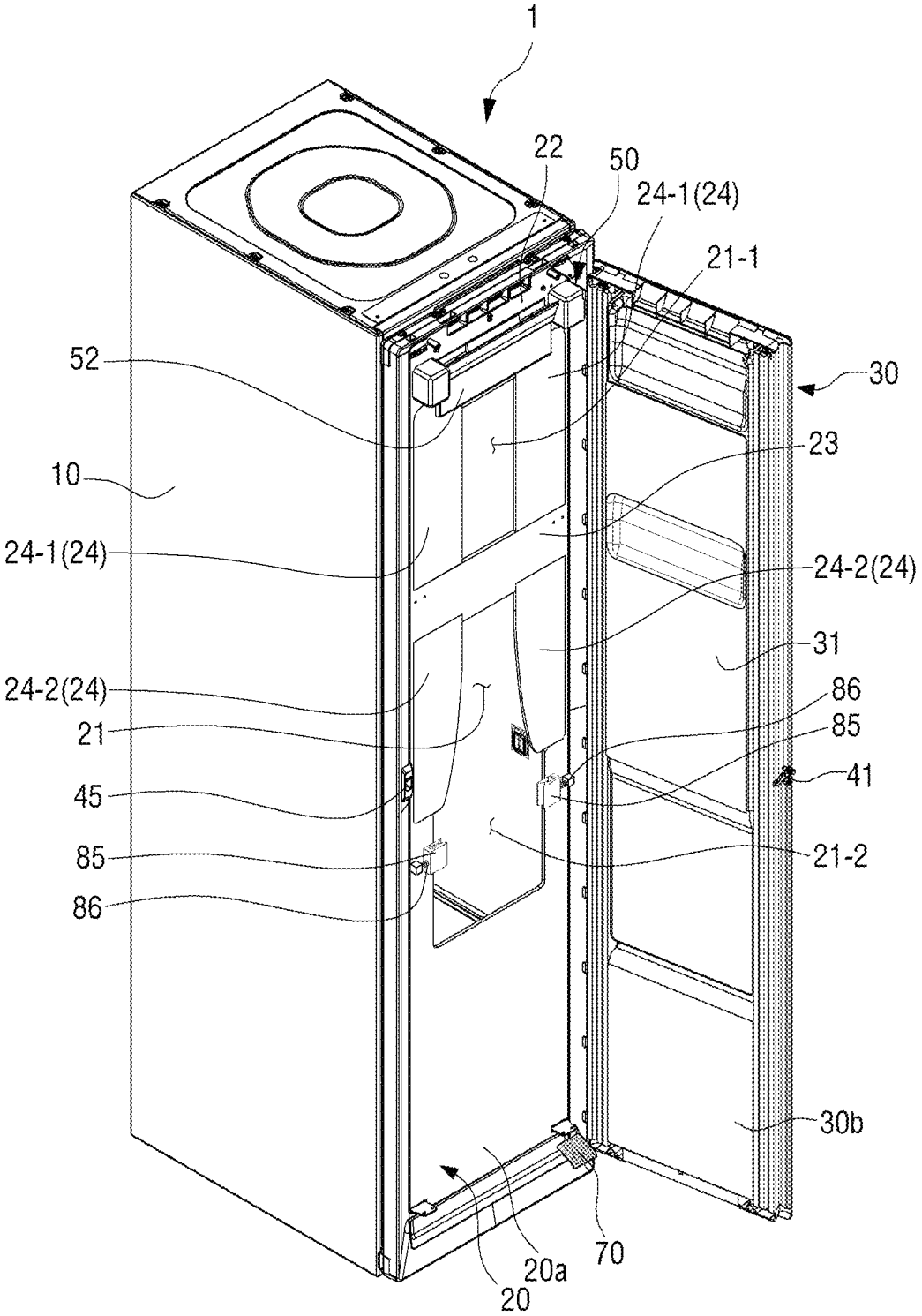
FIG. 2 is a perspective view illustrating a clothes treatment apparatus according to an embodiment in which an outer door is opened.
Figure 3:
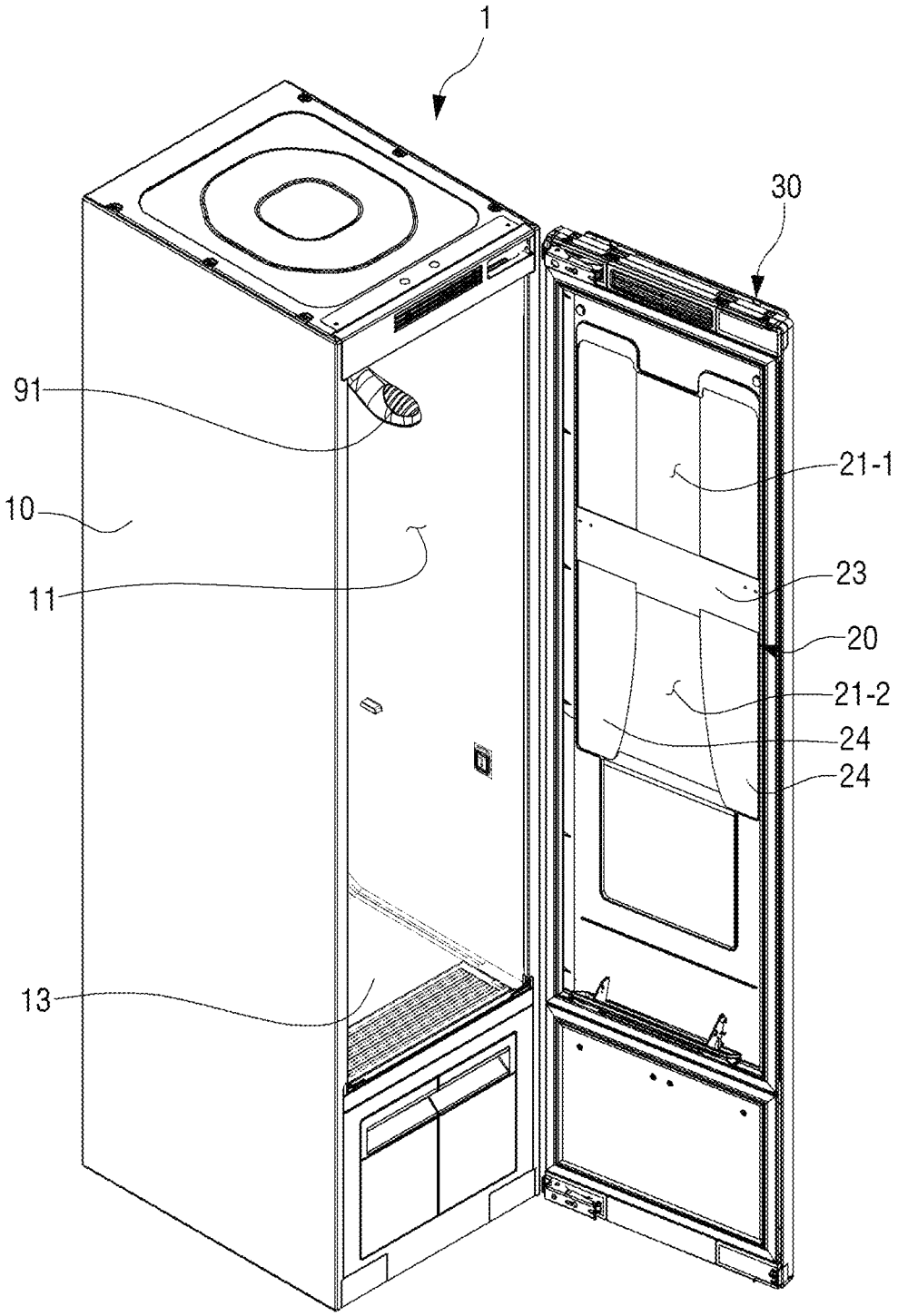
FIG. 3 is a perspective view illustrating a clothes treatment apparatus according to an embodiment in which an inner door is opened.
Figure 4:
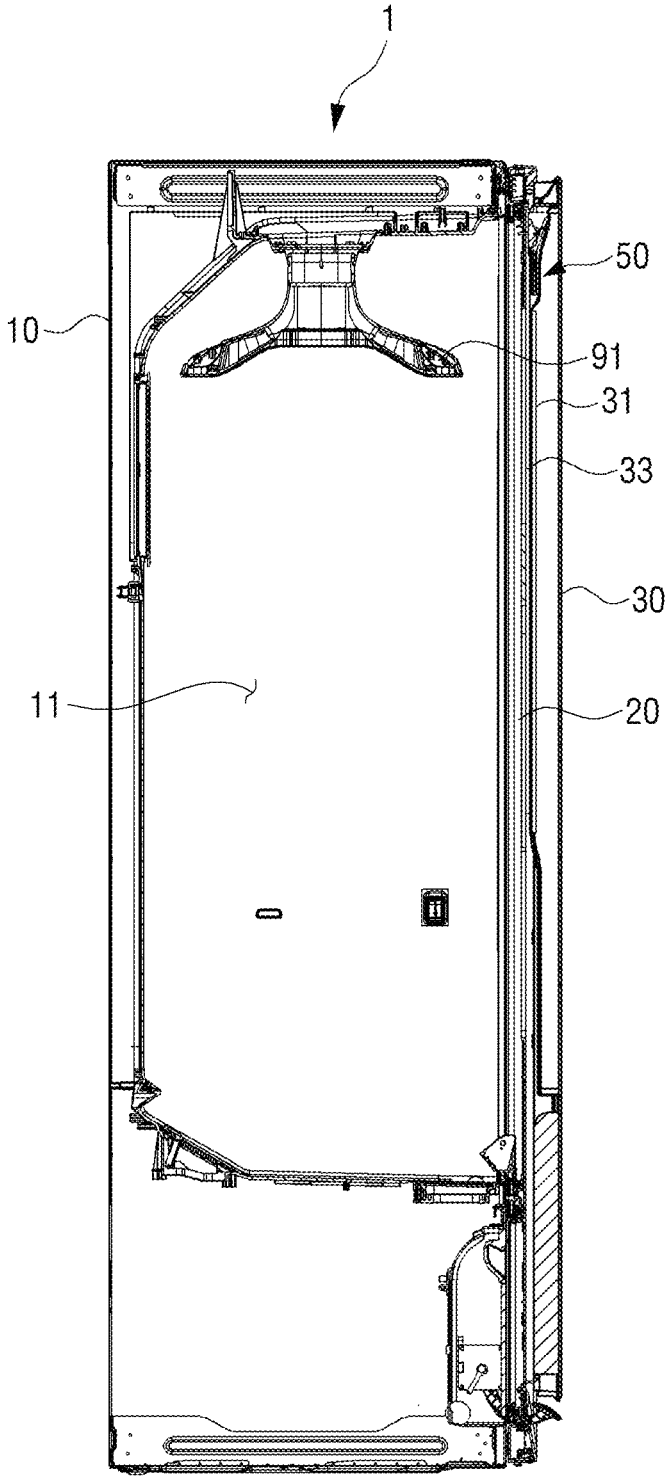
FIG. 4 is a cross-sectional view illustrating the clothes treatment apparatus of FIG. 1 taken along line I-I.

FIG. 1 is a perspective view illustrating a clothes treatment apparatus according to an embodiment. FIG. 2 is a perspective view illustrating a clothes treatment apparatus according to an embodiment in which an outer door is opened. FIG. 3 is a perspective view illustrating a clothes treatment apparatus according to an embodiment in which an inner door is opened. FIG. 4 is a cross-sectional view illustrating the clothes treatment apparatus of FIG. 1 taken along line I-I.

Referring to FIGS. 1, 2, and 3, a clothes treatment apparatus 1 according to an embodiment of the disclosure may include a cabinet 10, an inner door 20, and an outer door 30.

The cabinet 10 forms the appearance of the clothes treatment apparatus 1 and may be formed in a substantially rectangular parallelepiped shape. An accommodation space 11 in which clothes may be accommodated is provided inside the cabinet 10. The front surface of the cabinet 10 is open so that clothes may be put in and out of the accommodation space 11. The inner door 20 and the outer door 30 are provided on the front of the cabinet 10 to open and close the accommodation space 11.

The cabinet 10 may be divided into two spaces by an intermediate plate 13. An upper side of the intermediate plate 13 forms the accommodation space 11 in which clothes are accommodated, and an injection device and a circulation device may be disposed in a space under the intermediate plate 13.

The inner door 20 may be disposed to be rotatable with respect to the front surface of the cabinet 10. The inner door 20 may be hinged to one side of the front surface of the cabinet 10. Accordingly, the inner door 20 may rotate with respect to the cabinet 10 based on the hinge. When the inner door 20 is closed, the accommodation space 11 of the cabinet 10 is closed.

The inner door 20 may be provided with an opening 21. The opening 21 may be formed in a shape similar to the outline of the pants. For example, as illustrated in FIG. 2, the width of the upper end of the opening 21 may be narrow, and the width of the lower end of the opening 21 may be wider than that of the upper end of the opening 21. The lower portion of the opening 21 may be formed to have the same width as the lower end of the opening 21 to a predetermined height.

In addition, the width of the opening 21 may be formed to be smaller than the width of the pants. Further, the opening 21 may be divided into an upper opening 21-1 and a lower opening 21-2 by the second holder mounting portions 23.

Therefore, the inner portion of the pants is exposed through the opening 21, and the edge of the pants may be supported by the inner door 20. When a transparent window 24 is provided on the inner door 20, the edge of the pants may be supported by the transparent window 24. Steam and compressed air in the accommodation space 11 may be supplied to a space 33 between the inner door 20 and the outer door 30 through the opening 21 of the inner door 20.

The transparent window 24 may be provided on both sides of the opening 21 in the inner door 20. The user may check the mounting state of clothes, for example, pants, that are mounted in the space 33 between the inner door 20 and the outer door 30 through the transparent window 24. In addition, the transparent window 24 may be divided into an upper transparent window 24-1 and a lower transparent window 24-2 by a second holder mounting portion 23.

The outer door 30 may be disposed on the outside of the inner door 20 by hinges so as to be rotatable with respect to each of the cabinet 10 and the inner door 20. The outer door 30 may form the space 33 in which clothes are accommodated, that is, an ironing space, between the front surface of the inner door 20 and the outer door 30.

In addition, the outer door 30 may be hinged to rotate with respect to the cabinet 10 together with the inner door 20 or with respect to the inner door 20 separately from the inner door 20.

Accordingly, as illustrated in FIG. 2, the outer door 30 may be opened while the inner door 20 is fixed to the cabinet 10. Alternatively, as illustrated in FIG. 3, the inner door 20 and the outer door 30 may be opened in a coupled state to open the accommodation space 11 of the cabinet 10.

A door coupling device 40 may be provided between the inner door 20 and the outer door 30, so that the outer door 30 is fixed to the inner door 20 so that the outer door 30 may be rotated integrally with the inner door 20 or the outer door 30 may be rotated regardless of the inner door 20. An example of the door coupling device 40 is illustrated in FIG. 5.

Figure 5:
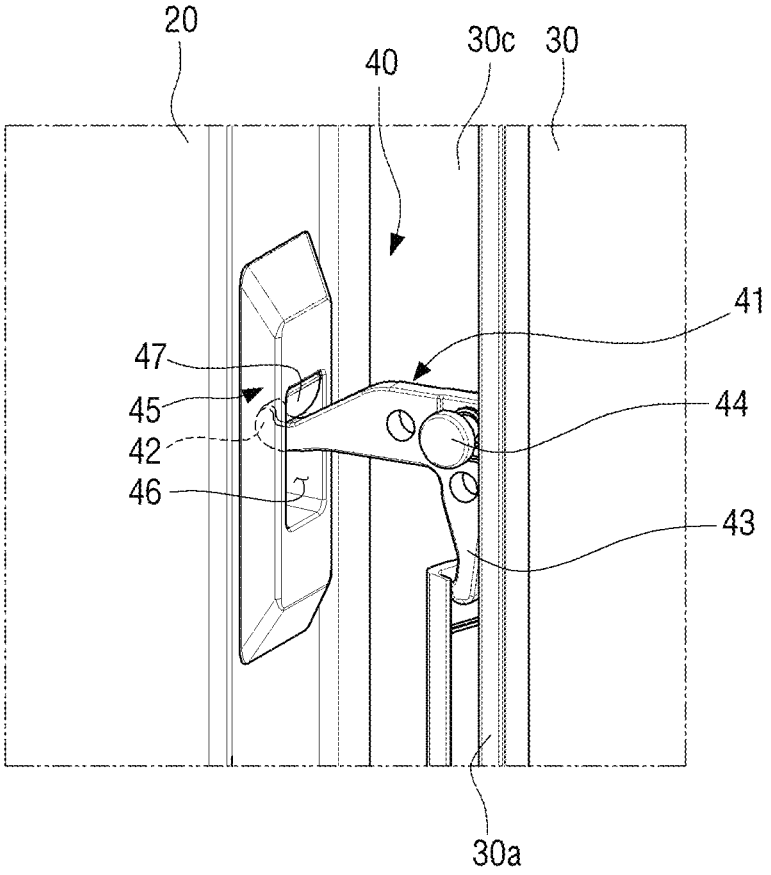
FIG. 5 is a partial perspective view illustrating a door coupling device of a clothes treatment apparatus according to an embodiment.

FIG. 5 is a partial perspective view illustrating a door coupling device of a clothes treatment apparatus according to an embodiment.

Referring to FIG. 5, the door coupling device 40 may include a fixing lever 41 disposed in the outer door 30 and a fixing part 45 disposed in the inner door 20.

The fixing lever 41 may be rotatably disposed on the side surface 30*c* of the outer door 30. The fixing lever 41 may be formed in an approximately L-shape, and have one end provided with a locking part 42 that is caught on the fixing part 45 of the inner door 20 and the other end provided with an operating part 43. A rotation shaft 44 may be provided on the central portion of the fixing lever 41 and fixed to the side surface 30*c* of the outer door 30.

The front surface 30*a* of the outer door 30 may extend from the side surface 30*c* of the outer door 30 so as to cover the fixing lever 41. Accordingly, the fixing lever 41 may be covered by the outer door 30, so that the fixing lever 41 is not visible from the front of the clothes treatment apparatus 1.

The fixing part 45 may be provided in one side of the front surface 20*a* of the inner door 20, and may include an insertion groove 46 into which the locking part 42 of the fixing lever 41 is inserted and a locking jaw 47 by which the locking part 42 is caught. The locking jaw 47 may be provided above the entrance of the insertion groove 46.

Therefore, when the locking part 42 of the fixing lever 41 is inserted into the insertion groove 46 of the fixing part 45 and then rotated upward by a certain angle, the locking part 42 is caught by the locking jaw 47 so that the fixing lever 41 does not come off from the fixing part 45. When the locking part 42 of the fixing lever 41 of the outer door 30 is caught by the locking jaw 47 of the fixing part 45 of the inner door 20, the outer door 30 may rotate integrally with the inner door 20.

When the user presses the operating part 43 of the fixing lever 41 toward the front surface 30*a* of the outer door 30, that is, when a force is applied to the operating part 43 of the fixing lever 41 in the counter-clockwise direction, the fixing lever 41 is rotated about the rotation shaft 44 so that the locking part 42 of the fixing lever 41 is released from the locking jaw 47 of the fixing part 45. In this state, when the outer door 30 is rotated, the outer door 30 may be rotated separately from the inner door 20.

The outer door 30 may include a heating plate 31. The heating plate 31 may be formed to apply heat to clothes positioned between the outer door 30 and the inner door 20. The heating plate 31 disposed on the outer door 30 and the front surface of the inner door 20 may form the space 33 in which clothes are accommodated.

Accordingly, the heating plate 31 may contact or be adjacent to the clothes positioned in the space 33 between the inner door 20 and the outer door 30. The heating plate 31 may perform an ironing function by applying heat to the clothes positioned between the outer door 30 and the inner door 20.

For example, the heating plate 31 may be disposed on the rear surface 30*b* of the outer door 30. The heating plate 31 may be formed so as to generate heat when power is applied and not to generate heat when power is cut off. For example, the heating plate 31 may be formed in a flat plate shape. The heating plate 31 may be formed in a structure in which a heating wire is disposed inside the flat plate. However, the structure of the heating plate 31 is not limited thereto. As long as heat can be generated by the supply of power, the heating plate 31 may be formed in various structures.

Figure 6:
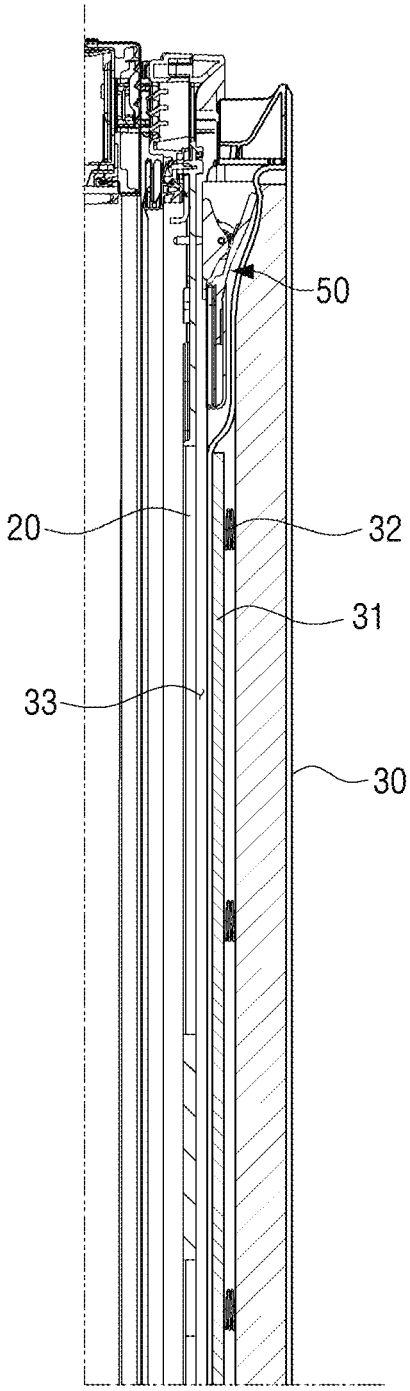
FIG. 6 is a partial cross-sectional view illustrating another example of a heating plate disposed on an outer door of a clothes treatment apparatus according to an embodiment.

As another example, as illustrated in FIG. 6, the heating plate 31 may be disposed to be elastically supported on the rear surface of the outer door 30. FIG. 6 is a partial cross-sectional view illustrating another example of a heating plate disposed on an outer door of a clothes treatment apparatus according to an embodiment.

Referring to FIG. 6, a plurality of elastic members 32 are disposed between the heating plate 31 and the rear surface of the outer door 30. Accordingly, the heating plate 31 may pressurize the clothes, for example, pants, mounted between the inner door 20 and the outer door 30 with a predetermined pressure. As illustrated in FIG. 6, in the case that the heating plate 31 is formed to apply heat and pressure to the pants at the same time, when the pants are mounted between the outer door 30 and the inner door 20 and the ironing course is performed, the knife-edge creases of the pants may be more reliably maintained.

When the outer door 30 is closed with respect to the inner door 20, the space 33 for receiving clothes, that is, an ironing space, is formed between the inner door 20 and the outer door 30. For example, the space 33 between the inner door 20 and the outer door 30 may be formed so that pants may be mounted therein.

Referring to FIG. 4, a holding device 50 may be disposed at the upper side of the space 33 between the inner door 20 and the outer door 30 to hold one end of clothes, for example, one end of pants.

Hereinafter, an example of the holding device 50 used in the clothes treatment apparatus 1 according to an embodiment of the disclosure will be described in detain with reference to FIGS. 4, 7, 8, 9, and 10.

Figure 7:
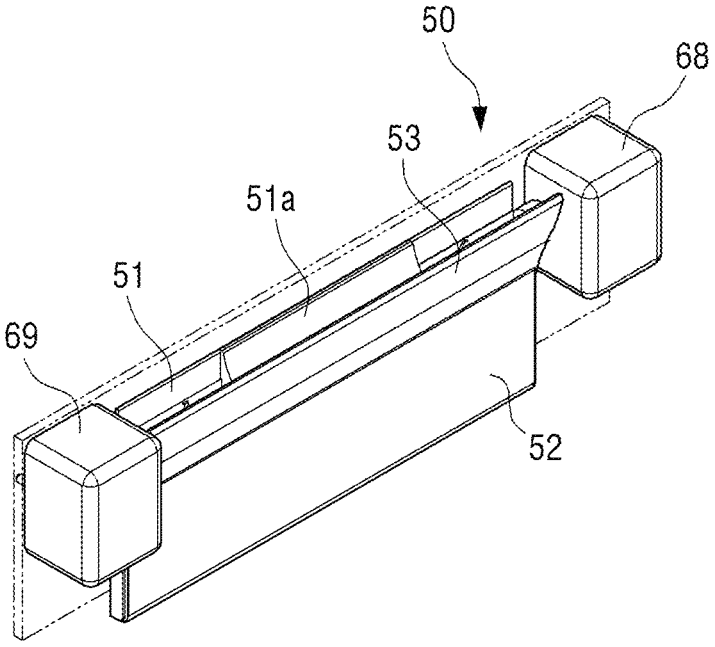
FIG. 7 is a perspective view illustrating a holding device of a clothes treatment apparatus according to an embodiment.
Figure 8:
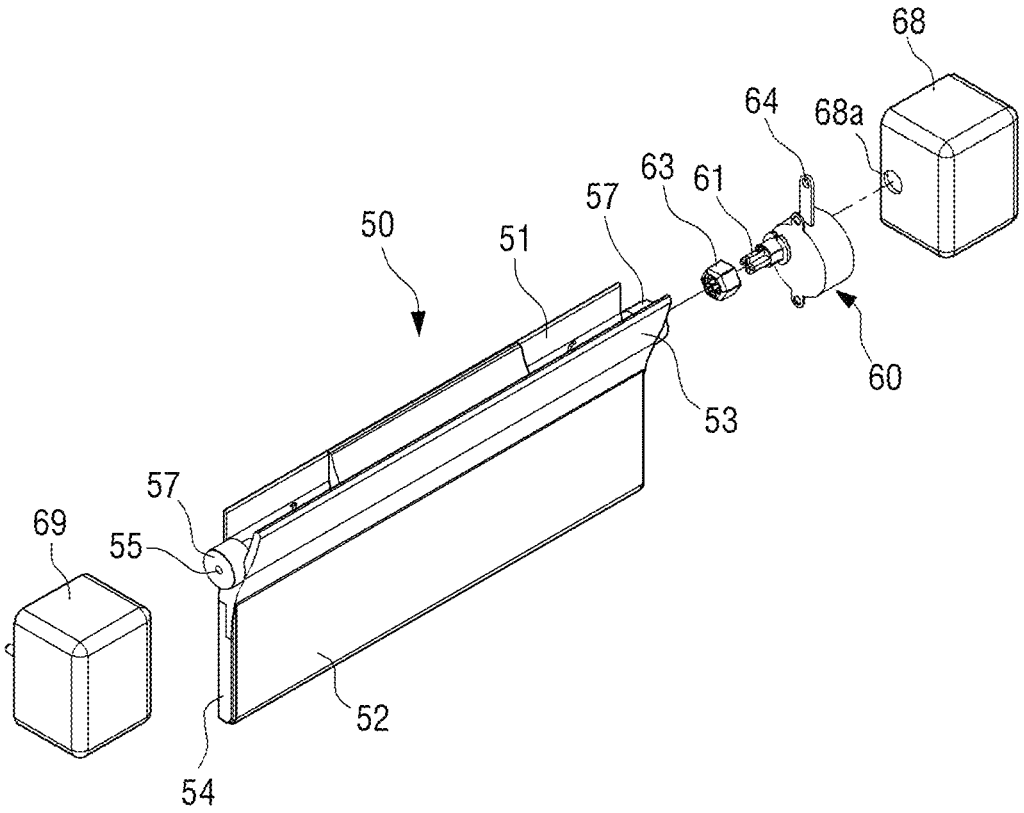
FIG. 8 is an exploded perspective view illustrating the holding device of FIG. 7.
Figure 9:
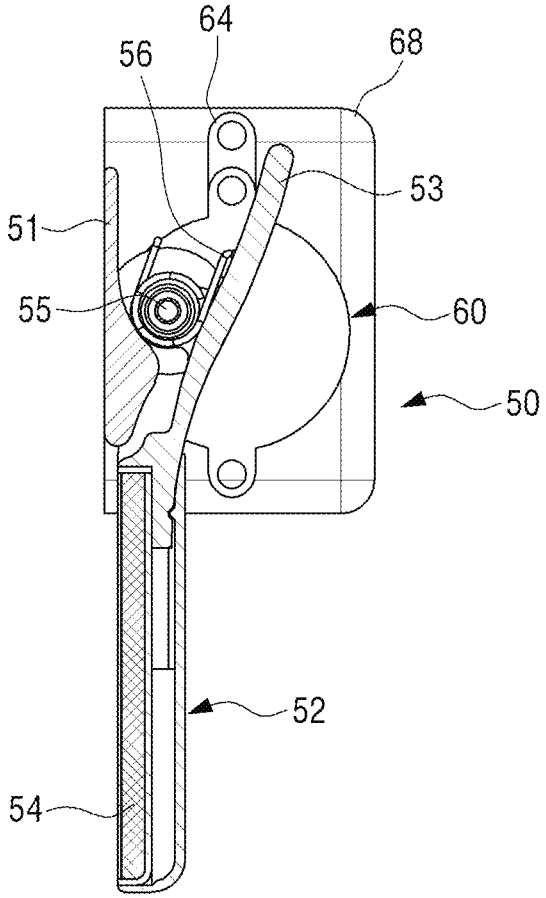
FIG. 9 is an cross-sectional view illustrating the holding device of FIG. 7.
Figure 10:
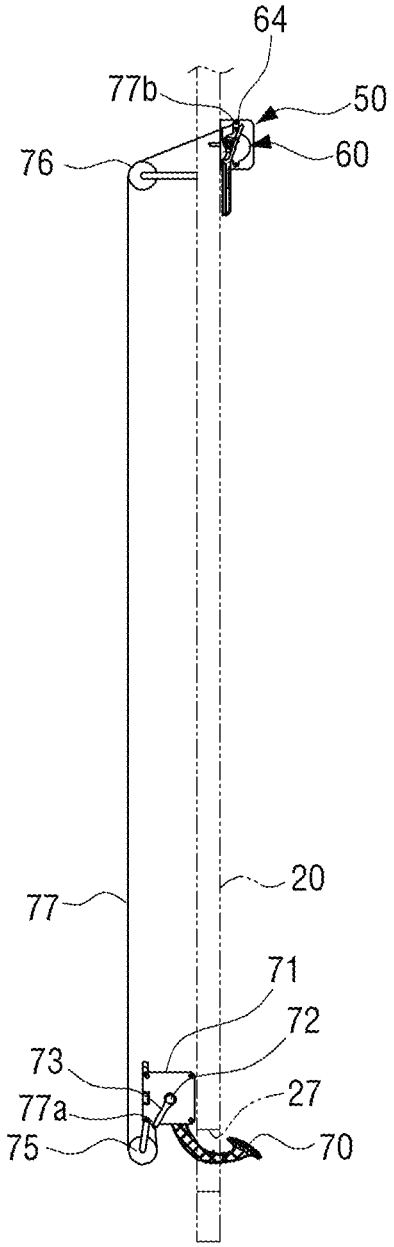
FIG. 10 is a view illustrating a holding device according to an embodiment disposed on an inner door.

FIG. 7 is a perspective view illustrating a holding device of a clothes treatment apparatus according to an embodiment. FIG. 8 is an exploded perspective view illustrating the holding device of FIG. 7. FIG. 9 is a cross-sectional view illustrating the holding device of FIG. 7. FIG. 10 is a view illustrating a holding device according to an embodiment disposed on an inner door.

Referring to FIGS. 7, 8, and 9, the holding device 50 may include a base plate 51 and a pressing plate 52.

The base plate 51 may be disposed on the front surface 20*a* of the inner door 20 and support the pressing plate 52 to rotate. The base plate 51 may include a support portion 51*a* that rotatably supports a hinge shaft 55. The support portion 51*a* is provided with a through hole into which the hinge shaft 55 is inserted.

The pressing plate 52 may be formed in a flat plate having a substantially rectangular shape, and may be hinged to be pivotable with respect to the base plate 51. The pressing plate 52 may be disposed so that the pressing plate 52 is rotated at a certain angle around the hinge shaft 55. A pair of support protrusions 57 into which both ends of the hinge shaft 55 are inserted may be provided at both side ends of the pressing plate 52. A release part 53 may be provided at one end of the pressing plate 52. The release part 53 may be formed to be inclined upward at a predetermined angle with respect to the pressing plate 52.

The pressing plate 52 may be formed to apply a predetermined force toward the front surface of the inner door 20. Accordingly, the pressing plate 52 may press one end of the clothes to fix the clothes to the front surface of the inner door 20. To this end, a pressing member may be disposed between the base plate 51 and the pressing plate 52.

A torsion spring 56 may be used as the pressing member. In this embodiment, two torsion springs 56 are provided on the hinge shaft 55 on both sides of the support portion 51*a* of the base plate 51. The torsion spring 56 may be formed to apply a predetermined force to the clothes so that the clothes do not fall out between the pressing plate 52 and the inner door 20 by its own weight when the pressing plate 52 presses the clothes.

On the other hand, when the user presses the release part 53 of the pressing plate 52, the pressing plate 52 is rotated in the opposite direction, so that the gap between the pressing plate 52 and the front surface of the inner door 20 is widened. Accordingly, the user may separate the clothes between the pressing plate 52 and the inner door 20.

The pressing plate 52 may include a heating member 54. The heating member 54 may be disposed on the inner surface of the pressing plate 52 and may be formed to generate heat when power is applied thereto. Accordingly, the holding device 50 may apply a predetermined pressure and heat to a portion pressed by the pressing plate 52.

The holding device 50 may be manually operated by the user. In other words, the user presses the release part 53 of the pressing plate 52 by hand, the pressing plate 52 is separated from the front surface of the inner door 20, so that the user may place the clothes between the pressing plate 52 and the front surface of the inner door 20. When the user removes the force applied to the release part 53 of the pressing plate 52, the pressing plate 52 presses the clothes by the elastic force of the torsion spring 56.

As another example, the holding device 50 may be formed so that the user manipulate the holding device 50 with his or her foot.

For example, the holding device 50 may further include a pedal 70 that is disposed at a lower portion of the inner door 20 and formed to rotate the pressing plate 52. Therefore, when a force is applied to the pedal 70, the pressing plate 52 may be rotated in a direction away from the front surface of the inner door 20. When the force applied to the pedal 70 is removed, the pressing plate 52 may press the front surface of the inner door 20.

To this end, the holding device 50 may include a drive part 60 operated by the pedal 70. The drive part 60 may be disposed on one side of the pressing plate 52 and may be formed to rotate the pressing plate 52 at a predetermined angle.

Referring to FIG. 8, the drive part 60 may include a drive shaft 61 protruding from the front surface of the drive part 60 and a link 64 protruding from the side surface of the drive part 60. The drive part 60 may be formed so that when the link 64 is rotated by a certain angle by a force applied to the tip of the link 64, the drive shaft 61 is rotated.

A male coupler 62 may be disposed at the tip of the drive shaft 61. A female coupler 63 configured to be coupled to the male coupler 62 of the drive shaft 61 may be disposed at the support protrusion 57 of the pressing plate 52. Therefore, when the male coupler 62 of the drive part 60 is coupled to the female coupler 63 of the pressing plate 52, the pressing plate 52 may be rotated according to the rotation of the drive shaft 61 of the drive part 60.

The drive part 60 may be disposed inside a cover 68. A hole 68*a* through which the drive shaft 61 of the drive part 60 protrudes is provided on one surface of the cover 68. A dummy cover 69 may be provided on the other side of the pressing plate 52. The dummy cover 69 may have the same shape as the cover 68 and be disposed to be symmetrical with the cover 68.

The cover 68 and the dummy cover 69 may be disposed to be fixed to the base plate 51. In this case, the base plate 51 may be formed to support the cover 68 and the dummy cover 69.

The pressing plate 52 may be formed to be rotated by a wire 77 connecting the drive part 60 and the pedal 70.

Referring to FIG. 10, the holding device 50 is disposed at the upper portion of the front surface of the inner door 20, and the pedal 70 is disposed at the lower portion of the inner door 20. An upper pulley 76 for supporting and guiding the wire 77 is disposed on the upper portion of the rear surface of the inner door 20, and a lower pulley 75 for supporting and guiding the wire 77 is disposed on the lower portion of the rear surface of the inner door 20.

One end of the pedal 70 is rotatably disposed on a pedal shaft 72 disposed in a pedal housing 71, and the other end of the pedal 70 protrudes from the inner door 20 through a through hole 27 formed at the lower portion of the inner door 20. Accordingly, the pedal 70 may rotate at a certain angle based on the pedal shaft 72. In addition, the pedal 70 may be supported by a restoring elastic member 74 (see FIG. 11A) to return to its original position.

The pedal housing 71 may be disposed on the rear surface of the inner door 20. The restoring elastic member 74 is disposed inside the pedal housing 71 to rotate the pedal 70 in the counter-clockwise direction by a predetermined angle.

In the case of this embodiment, two coil springs are used as the restoring elastic member 74. The coil spring 74 is disposed so that one end of the coil spring 74 is supported by the inner surface of the pedal housing 71, and the other end thereof is supported by the pedal 70. When a force is applied to the pedal 70 in the clockwise direction, the coil spring 74 is compressed and the pedal 70 is rotated at a certain angle in the clockwise direction. When the force applied to the pedal 70 is removed, the pedal 70 is rotated in the counter-clockwise direction by the elastic force of the coil spring 74 to return to its original position. The lower pulley 75 may be disposed on the lower surface of the pedal housing 71.

A rotation link 73 that rotates integrally with the pedal 70 may be disposed at one end of the pedal 70. Accordingly, when the pedal 70 rotates, the rotation link 73 rotates integrally with the pedal 70. One end 77*a* of the wire 77 is connected to one end of the rotation link 73.

The wire 77 is connected to the link 64 of the drive part 60 through the lower pulley 75 and the upper pulley 76. In other words, the other end 77*b* of the wire 77 is fixed to one end of the link 64 of the drive part 60. Accordingly, when the pedal 70 rotates, the link 64 of the drive part 60 is rotated so that the pressing plate 52 is rotated.

Hereinafter, the operation of the pressing plate 52 by the pedal 70 will be described in detail with reference to FIGS. 11A and 11B.

Figure 11A:
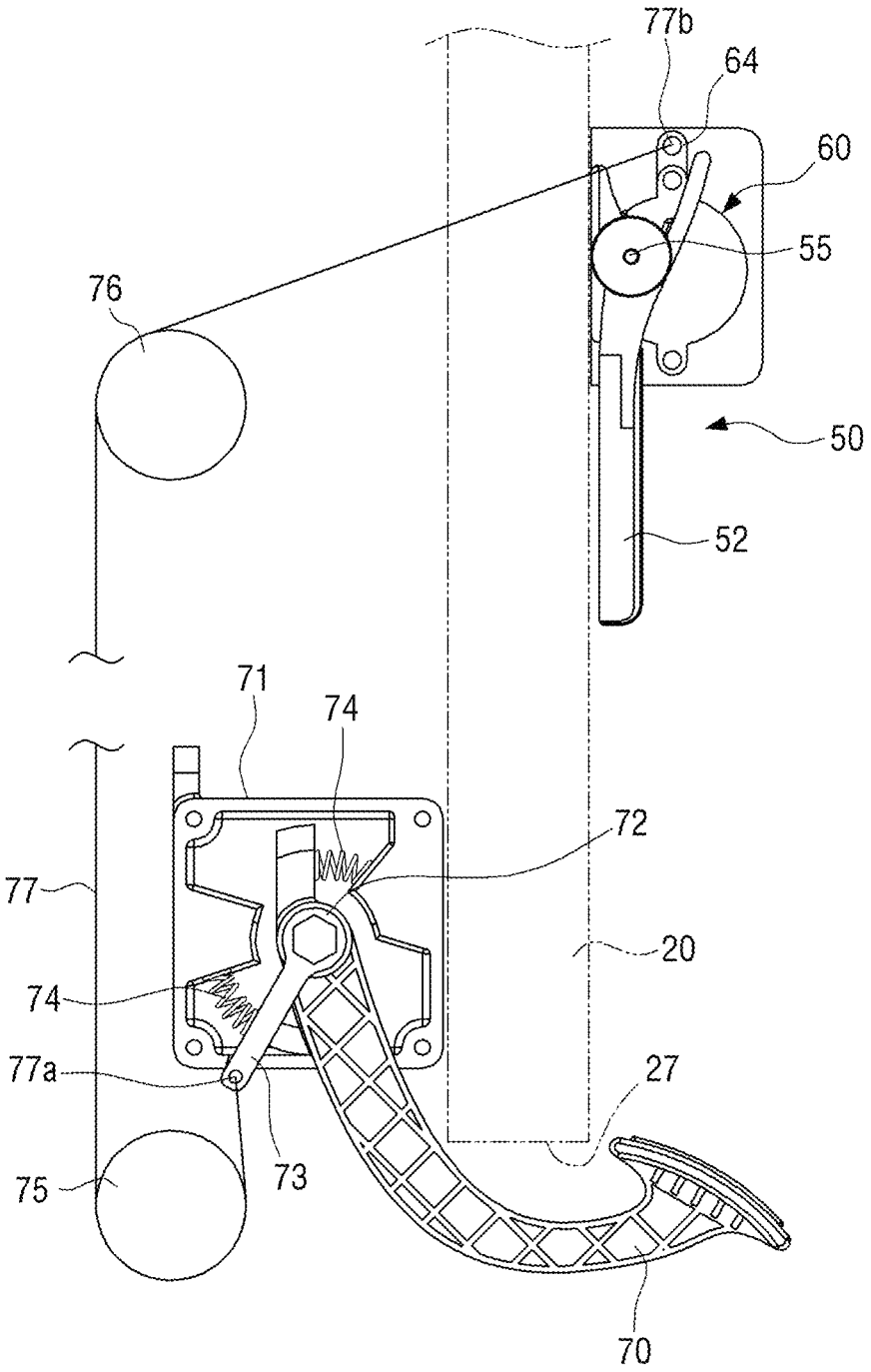
FIG. 11A is a view illustrating a state in which a holding device according to an embodiment is closed.
Figure 11B:
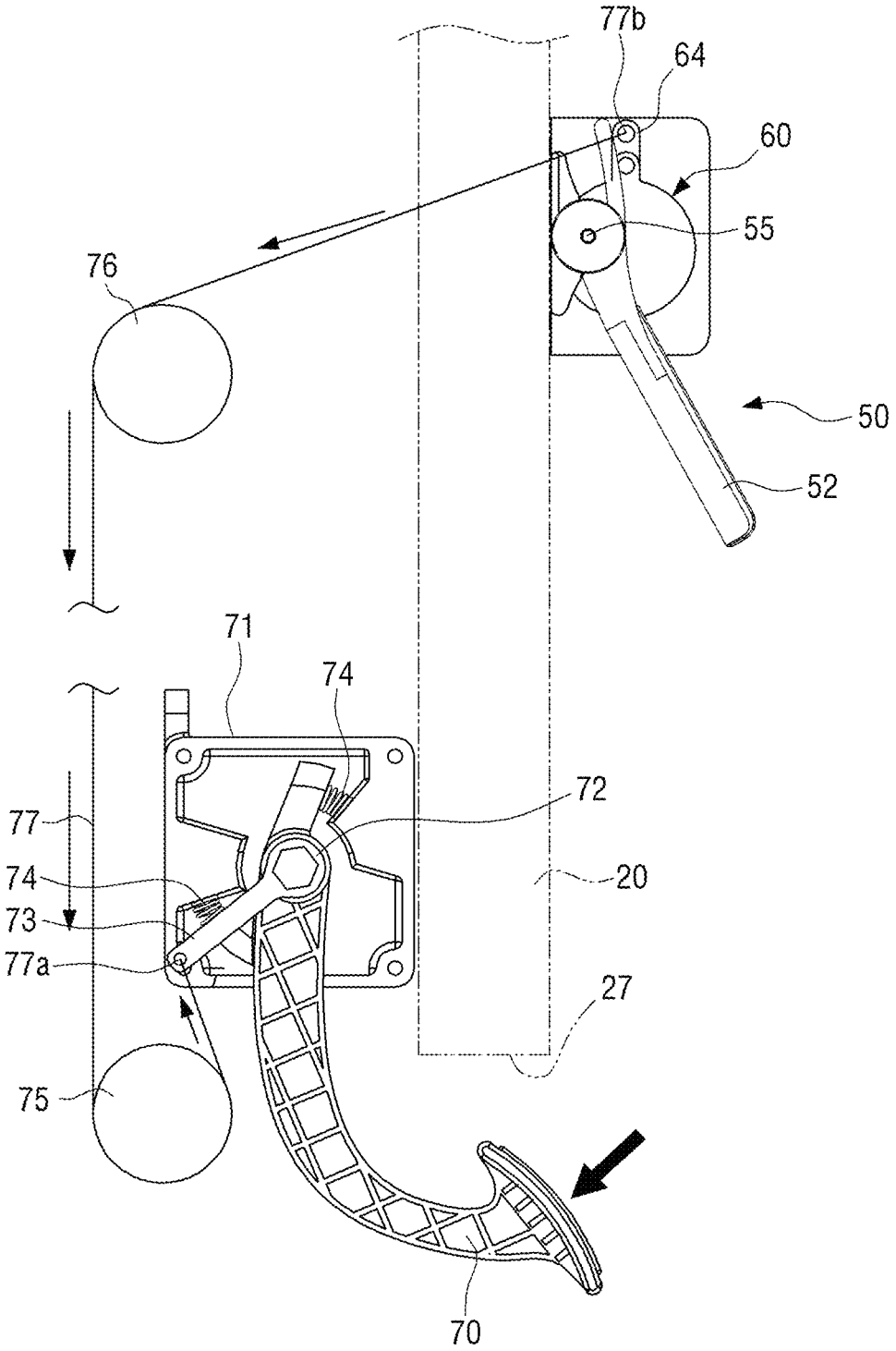
FIG. 11B is a view illustrating a state in which a holding device according to an embodiment is opened.

FIG. 11A is a view illustrating a state in which a holding device according to an embodiment is closed, and FIG. 11B is a view illustrating a state in which a holding device according to an embodiment is opened.

When the user does not step on the pedal 70, that is, when no force is applied to the pedal 70, as illustrated in FIG. 11A, the pressing plate 52 of the holding device 50 maintains a closed state in which the pressing plate 52 is close to front surface of the inner door 20.

When the user steps on the pedal 70, that is, when a force is applied to the pedal 70, as illustrated in FIG. 11B, the pedal 70 rotates in the clockwise direction based on the pedal shaft 72. Then, the rotation link 73 rotates in the clockwise direction in the same manner as the pedal 70.

When the rotation link 73 rotates in the clockwise direction, the wire 77 connected to the rotation link 73 is moved upward. When the wire 77 moves upward, the link 64 of the drive part 60 connected to the other end 77*b* of the wire 77 is rotated in the counter-clockwise direction.

When the link 64 of the drive part 60 rotates in the counter-clockwise direction, the drive shaft 61 of the drive part 60 is also rotated in the counter-clockwise direction. Then, the pressing plate 52 connected to the drive shaft 61 also rotates in the counter-clockwise direction based on the hinge shaft 55, so that the pressing plate 52 is opened apart from the front surface of the inner door 20. In other words, the holding device 50 is in an open state.

In this way, when the pressing plate 52 of the holding device 50 is opened by pressing the pedal 70 with the foot, the user places one end of the clothes, for example, pants, under the pressing plate 52 by hand. Thereafter, when the user releases his or her foot from the pedal 70, the pressing plate 52 presses the one end of the pants by the pressing member, that is, two torsion springs 56. At this time, the pedal 70 is rotated in the counter-clockwise direction by the two coil springs 74 to return to its original position.

When the holding device 50 is operated using the pedal 70 as described above, the user may fix the clothes to the holding device 50 using both hands. Accordingly, it may be convenient that the user fixes the clothes to the front surface of the inner door 20.

Figure 12:
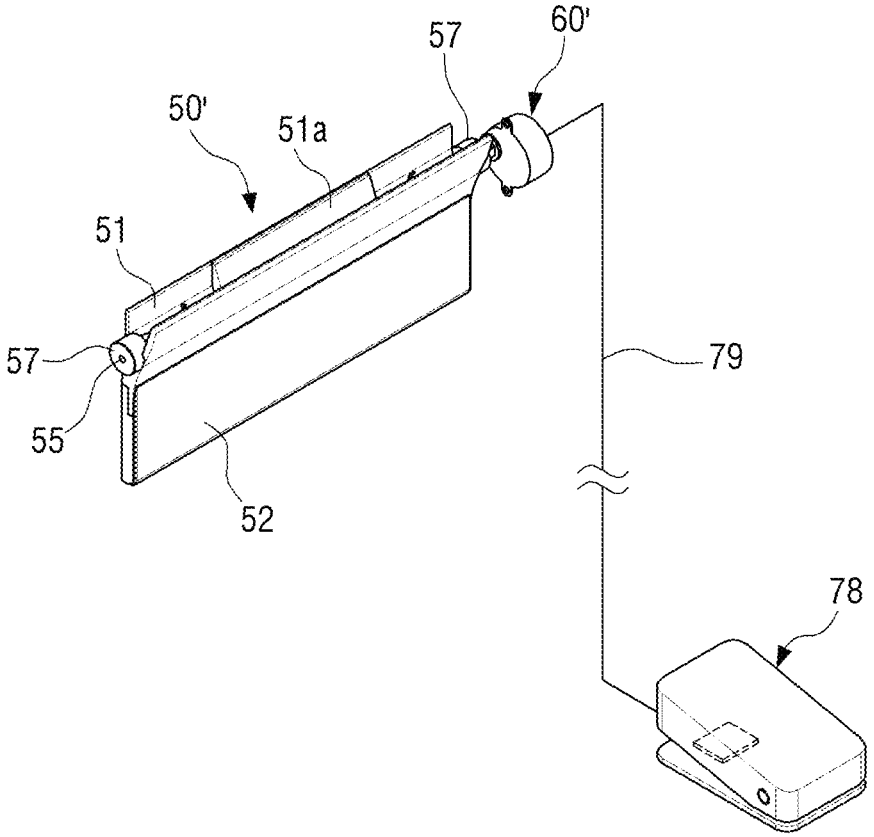
FIG. 12 is a perspective view illustrating a holding device according to another embodiment.

As another example, as illustrated in FIG. 12, the pressing plate may be formed to be rotated by a predetermined angle by a motor.

FIG. 12 is a perspective view illustrating a holding device according to another embodiment.

Referring to FIG. 12, a holding device 50' may include a base plate 51, a pressing plate 52, a motor 60', and a foot switch 78.

The base plate 51 and the pressing plate 52 are the same as the base plate 51 and the pressing plate 52 according to above-described embodiment; therefore, detailed descriptions thereof are omitted.

The motor 60' is disposed on one side of the pressing plate 52. The motor 60' may be electrically connected to the foot switch 78 through an electric wire 79.

The motor 60' may be disposed to rotate the pressing plate 52 of the holding device 50'. A rotation shaft of the motor 60' and the support protrusion 57 of the pressing plate 52 may be connected to each other by a coupler. The coupler may be formed in the same manner as the coupler shown in FIG. 8. In other words, the female coupler 63 may be disposed on the support protrusion 57 of the pressing plate 52, and the male coupler 62 may be fixed to the rotation shaft of the motor 60'. When the male coupler 62 fixed to the rotation shaft of the motor 60' is coupled to the female coupler 63 of the pressing plate 52, the motor 60' and the pressing plate 52 are coupled to each other. Accordingly, when the motor 60' operates, the pressing plate 52 may rotate.

The motor 60' may be formed so that when the motor 60' rotates in one direction, the motor 60' rotates the pressing plate 52 so that the pressing plate 52 overcomes the elastic force of the pressing member 56 and rotates in a direction in which the pressing plate 52 is spaced apart from the inner door 20.

The foot switch 78 may be disposed at the lower portion of the inner door 20, and may be formed to turn on and off the motor 60'. Accordingly, when the user presses the foot switch 78, that is, when a force is applied to the foot switch 78, the motor 60' is operated so that the rotation shaft of the motor 60' rotates. When the user does not press the foot switch 78, that is, when no force is applied to the foot switch 78, the motor 60' does not operate. At this time, the rotation shaft of the motor 60' may freely rotate.

Therefore, when a force is applied to the foot switch 78, the rotation shaft of the motor 60' rotates in one direction, so that the pressing plate 52 is spaced apart from the inner door 20. When the force applied to the foot switch 78 is removed, the motor 60' does not operate, and the pressing plate 52 is pressed toward the inner door 20 by the pressing member 56 so that the pressing plate 52 is in a closed state.

Hereinafter, the operation of the pressing plate 52 by the foot switch 78 will be described in detail with reference to FIGS. 13A and 13B.

Figure 13A:
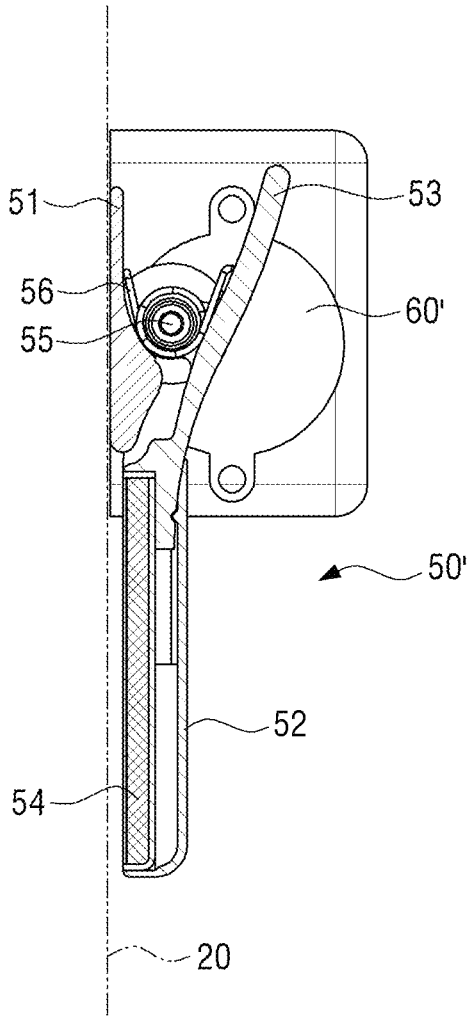
FIG. 13A is a view illustrating a state in which the holding device of FIG. 12 is closed.
Figure 13B:
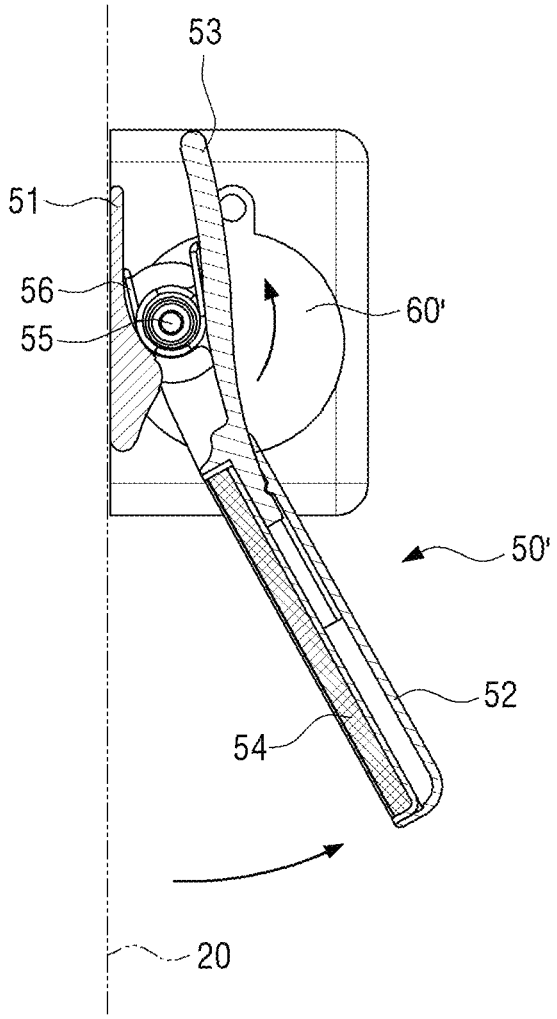
FIG. 13B is a view illustrating a state in which the holding device of FIG. 12 is opened.

FIG. 13A is a view illustrating a state in which the holding device of FIG. 12 is closed, and FIG. 13B is a view illustrating a state in which the holding device of FIG. 12 is opened.

When the user does not step on the foot switch 78, that is, when no force is applied to the foot switch 78, as illustrated in FIG. 13A, the pressing plate 52 of the holding device 50' maintains a closed state in which the pressing plate 52 is close to the front surface of the inner door 20.

When the user steps on the foot switch 78, that is, when a force is applied to the foot switch 78, the motor 60' operates so that the rotation shaft of the motor 60' rotates in the counter-clockwise direction. Then, the pressing plate 52 connected to the rotation shaft of the motor 60' also rotates in the counter-clockwise direction based on the hinge shaft 55, so that the pressing plate 52 is opened apart from the front surface of the inner door 20. In other words, the pressing plate 52 is in an open state.

In this way, when the pressing plate 52 of the holding device 50' is opened by pressing the foot switch 78 with the foot, the user places one end of the clothes, for example, pants, under the pressing plate 52 by hand. Thereafter, when the user releases his or her foot from the foot switch 78, the operation of the motor 60' is stopped. Then, the pressing plate 52 is rotated in the clockwise direction by the pressing member, that is, two torsion springs 56, and returns to the closed position. Then, the pressing plate 52 presses the one end of the pants.

When the holding device 50 is operated using the pedal 70 as described above, the user may fix the clothes to the holding device 50 using both hands. Accordingly, it may be convenient that the user fixes the clothes to the front surface of the inner door 20.

When the holding device 50' is operated using the foot switch 78 as described above, the user may fix the clothes to the holding device 50' using both hands. Accordingly, it may be convenient that the user fixes the clothes to the front surface of the inner door 20.

Hereinafter, another example of a holding device used in a clothes treatment apparatus according to an embodiment of the disclosure will be described with reference to FIG. 14.

Figure 14:
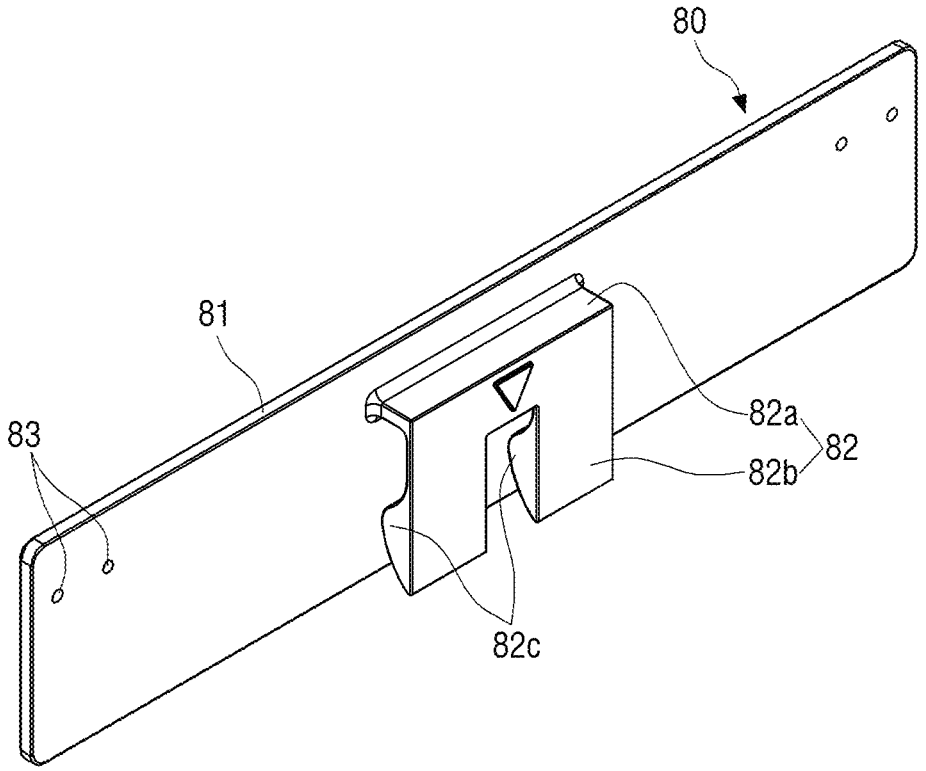
FIG. 14 is a perspective view illustrating a holding device according to another embodiment.

FIG. 14 is a perspective view illustrating a holding device according to another embodiment.

Referring to FIG. 14, a holding device 80 may include a base 81 and a pressing part 82.

The base 81 may be integrally formed with the pressing part 82. The pressing part 82 may be formed so that the leading end of the pressing part 82 is deformed as a certain angle with respect to the base 81 and then restored to its original state. Accordingly, one end of clothes may be inserted between the leading end of the pressing part 82 and the base 81. The holding device 80 including the base 81 and the pressing part 82 may be formed by injection molding a resin or plastic having elasticity.

For example, the base 81 may be formed in a rectangular flat plate. The pressing part 82 may include a vertical portion 82*a* extending substantially vertically from the base 81 and a parallel portion 82*b* extending substantially parallel to the base 81 from the vertical portion 82*a*. A jaw portion 82*c* may be provided on one surface of the parallel portion 82*b* facing the base 81 and may be formed to protrude toward the base 81.

Because the holding device 80 is formed of a resin or plastic having elasticity, the pressing part 82 has elasticity. Accordingly, the user may insert one end of the clothes between the base 81 and the jaw portion 82*c* of the pressing part 82. The inserted clothes may be fixed to the base 81 by the jaw portion 82*c* of the pressing part 82.

The base 81 may be fixed to the inner door 20. The base 81 may include a plurality of holes 83 for fixing the base 81 to the inner door 20.

A plurality of holder mounting portions 22 and 23 may be provided on the front surface of the inner door 20 to allow the holding devices 50, 50', and 80 to be disposed. The plurality of holder mounting portions 22 and 23 may be provided on the front surface 20*a* of the inner door 20 by a predetermined interval in the vertical direction.

Referring to FIG. 2, the inner door 20 includes two holder mounting portions, that is, a first holder mounting portion 22 and a second holder mounting portion 23. The first holder mounting portion 22 may be provided at the upper end portion of the inner door 20, and the second holder mounting portion 23 may be provided at a predetermined distance below the first holder mounting portion 22. The second holder mounting portion 23 may be provided slightly above the center of the inner door 20. The second holder mounting portion 23 may be provided in a position where it is easy for the user to fix one end of the clothes to the holding device 50 or 50' by hand.

A plurality of holes may be provided in the first and second holder mounting portions 22 and 23 to fix the holding device 50 or 50'. The holding device 50 or 50' may be fixed to the holder mounting portions 22 and 23 with fastening members such as screws.

Referring again to FIG. 2, a pair of clips 85 may be provided on both sides of the lower portion of the opening 21 of the inner door 20. In other words, the pair of clips 85 may be disposed under the holding device 50 or 50' in the space 33 between the inner door 20 and the outer door 30. The pair of clips 85 may be provided to pull both sides of the lower portion of the clothes C fixed to the holding device 50 or 50', for example, both sides of the lower portion of the pants (see FIG. 16).

Figure 15:
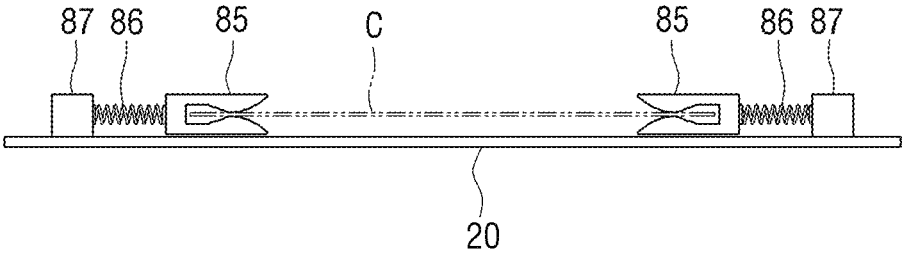
FIG. 15 is a side view illustrating a pair of clips of a clothes treatment apparatus according to an embodiment.

FIG. 15 is a side view illustrating a pair of clips of a clothes treatment apparatus according to an embodiment.

Referring to FIGS. 2 and 15, the leading end of the clip 85 may be formed so that the clothes C, for example, pants may be fixed by inserting the clothes into the leading end of the clip 85. In addition, the clips 85 may be slidably disposed with respect to the front surface of the inner door 20.

Each of the pair of clips 85 may include a spring 86. One end of the spring 86 is fixed to the rear end of the clip 85, and the other end of the spring 86 is fixed to a fixing piece 87 disposed on the inner door 20. The spring 86 may be formed of a shape memory alloy. In other words, the clips 85 may be elastically supported by a shape memory alloy spring 86.

The shape memory alloy spring 86 may be formed to contract when the ambient temperature, that is, the temperature inside the cabinet 10 increases. In other words, at room temperature, the shape memory alloy spring 86 is in an elongated stated, and when the temperature inside the cabinet 10 increases, the shape memory alloy spring 86 is in a contracted state.

The temperature inside the cabinet 10 may rise when the heating plate 31 of the outer door 30 operates or when steam is generated by an injection device. Therefore, when the heating plate 31 operates in the state where the outer door 30 is closed, the shape memory alloy spring 86 is contracted, so that the pair of clips 85 pull the clothes C. In this state, the heating plate 31 applies heat and pressure to the clothes C, so that ironing may be effectively performed.

In addition, at least one lower clip 88 capable of pulling the clothes C fixed to the holding device 50 or 50' in a downward direction may be disposed at the lower end of the opening 21 of the inner door 20.

Figure 16:
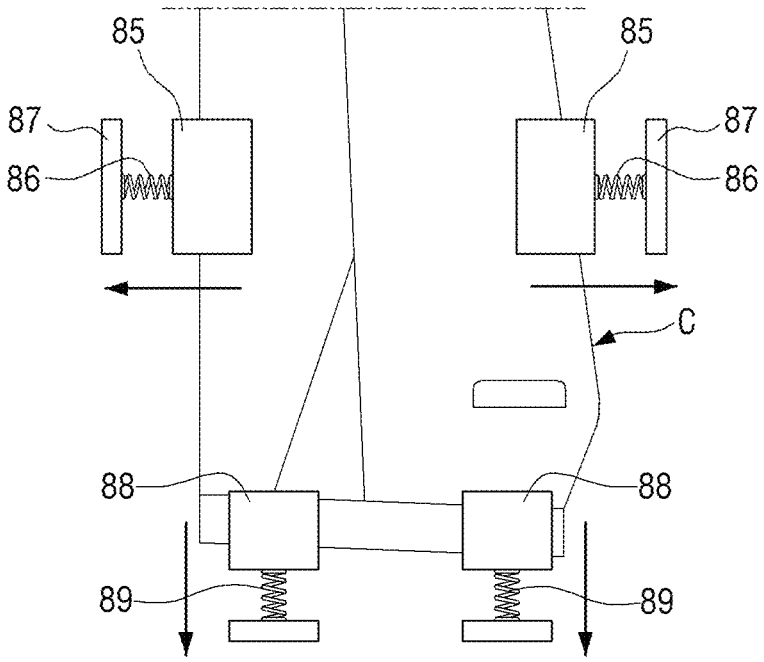
FIG. 16 is a partial front view illustrating an inner door of a clothes treatment apparatus according to an embodiment in which lower clips are disposed.

FIG. 16 is a partial front view illustrating an inner door of a clothes treatment apparatus according to an embodiment in which lower clips are disposed.

Referring to FIG. 16, two lower clips 88 may be disposed so that the lower clips 88 grab and pull downward the lower end of the pants C.

The lower clip 88 may be formed to be elastically supported by a shape memory alloy spring 89. The structure of the lower clip 88 is the same as that of each of the pair of clips 85 as described above; therefore, a detailed description thereof is omitted.

The clothes treatment apparatus 1 according to an embodiment of the disclosure may include a processor 90 for control.

Figure 17:
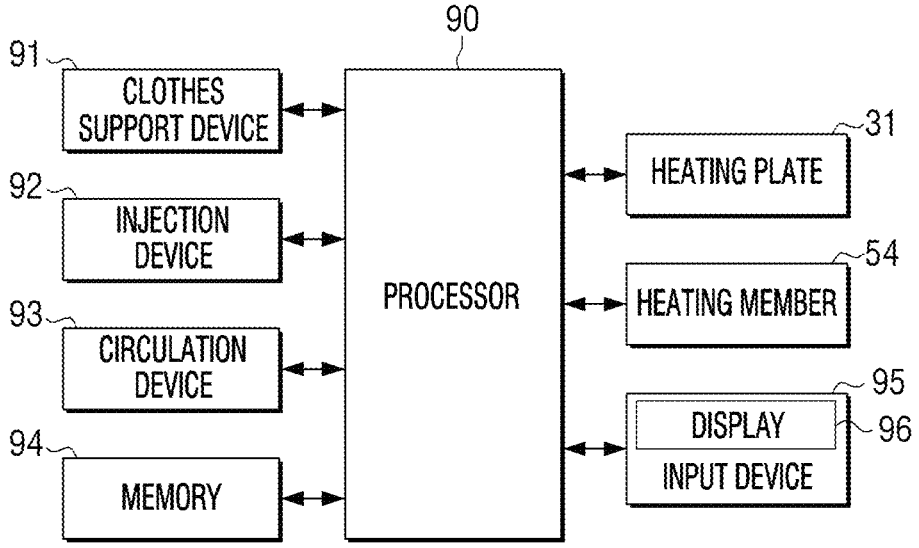
FIG. 17 is a block diagram illustrating a clothes treatment apparatus according to an embodiment.

FIG. 17 is a block diagram illustrating a clothes treatment apparatus according to an embodiment.

Referring to FIG. 17, the clothes treatment apparatus 1 may include a clothes support device 91, an injection device 92, a circulation device 93, a heating plate 31, a heating member 54, a memory 94, an input device 95, a display 96, and a processor 90.

The clothes support device 91 is provided in the accommodation space 11 of the clothes treatment apparatus 1 capable of accommodating clothes and may be formed to support and fix clothes. The clothes support device 91 may be disposed at the upper end of the accommodation space 11 and used for hanging clothes. In addition, the clothes support device 91 may be separated from and taken out from the accommodation space 11. The clothes support device 91 may be mounted in the accommodation space 11 again in a state in which the clothes support device 91 supports the clothes from the outside of the clothes treatment apparatus 1.

The injection device 92 may be formed to inject steam or air onto the clothes accommodated in the accommodation space 11. For example, the injection device 92 may inject high-temperature steam to change the fabric structure of the clothes into a flexible state. In addition, the injection device 92 may remove wrinkles from the clothes or remove dust from the clothes by injecting compressed air to press the clothes.

In addition, the injection device 92 may be disposed to be movable up and down along the accommodation space 11. The injection device 92 may evenly inject steam or air while moving up and down.

The circulation device 93 may be formed to circulate the air in the accommodation space 11. For example, the circulation device 93 may introduce high-temperature air into the accommodation space 11 and suck the air introduced into the accommodation space 11 again, thereby continuously circulating the high-temperature air into the accommodation space 11.

The circulation device 93 may continuously circulate high-temperature air in the accommodation space 11, thereby maintaining the fabric structure of the clothes in a flexible state, and drying the clothes by removing moisture from the clothes.

In addition, the circulation device 93 may include a heating source to generate the high-temperature air. The heating source may be formed as a heater or the like.

In addition, the circulation device 93 may be disposed under the accommodation space 11, that is, below the intermediate plate 13 to circulate the air in the accommodation space 11. However, the installation position of the circulation device 93 is not limited thereto.

The heating plate 31 may be disposed on the rear surface of the outer door 30 of the clothes treatment apparatus 1, and may be formed so that when power is applied, the heating plate 31 generates heat to perform ironing on clothes mounted in the space 33 between the outer door 30 and the inner door 20. The structure of the heating plate 31 has been described above; therefore, a detailed description thereof is omitted.

The heating member 54 may be disposed on the pressing plate 52 of the holding device 50 or 50'. The heating member 54 may be formed to generate heat when power is applied, thereby performing ironing on a special portion of clothes pressed by the pressing plate 52. The heating member 54 is the same as the heating member 54 of the holding device 50 or 50' described above; therefore, a detailed description thereof is omitted.

The memory 94 may store programs for processing or controlling of the processor 90 and various data for an operation of the clothes treatment apparatus 1. For example, the memory 94 may store a plurality of application programs driven by the clothes treatment apparatus 1, and data and instructions for the operation of the clothes treatment apparatus 1.

The memory 94 may be accessed by the processor 90, and data read/write/edit/delete/update by the processor 90 may be performed. The memory 94 may be implemented as an external storage medium, a removable disk including a USB memory, a web server through a network, and the like, as well as a storage medium in the clothes treatment apparatus 1.

Figure 18:
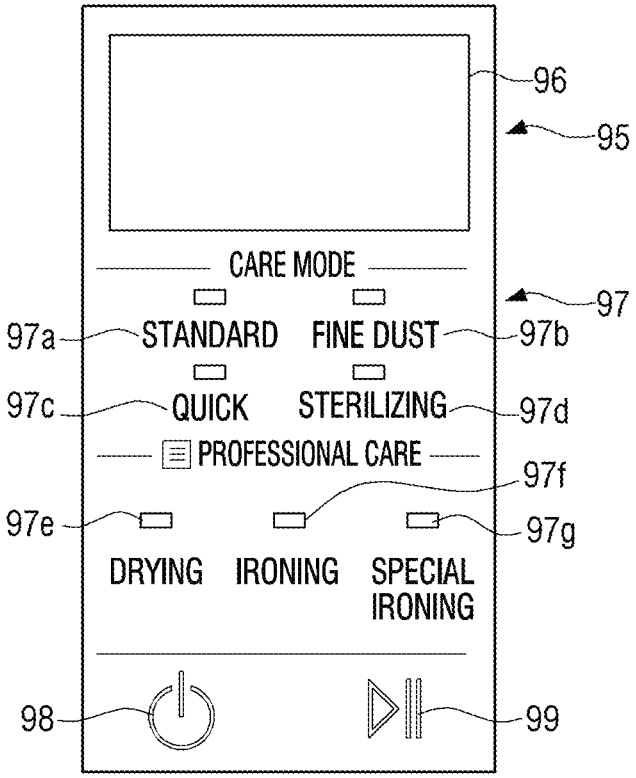
FIG. 18 is a view illustrating an input device of a clothes treatment apparatus according to an embodiment.

The input device 95 may receive a function selection and control commands for the selected function from the user. FIG. 18 illustrates an example of an input device used in a clothes treatment apparatus according to an embodiment.

Referring to FIG. 18, the input device 95 of the clothes treatment apparatus 1 may include a display 96, a plurality of course selection buttons 97 for selecting a clothes treatment course, a power button 98, and an operation button 99.

The display 96 may be formed to display information necessary for the user to control the clothes treatment apparatus 1, such as a selected clothes treatment course, a state of the clothes treatment apparatus 1, an abnormality detection alarm, and the like. The display 96 may be implemented as a liquid crystal display (LCD), a cathode ray tube (CRT), an organic light emitting diode (OLED), and the like capable of displaying such information.

The plurality of course selection buttons 97 may include a standard button 97*a* for selecting a standard course, a fine dust button 97*b* for selecting a course for removing fine dust, a quick button 97*c* for selecting a quick course for rapidly performing clothes treatment, and a sterilizing button 97*d* for selecting a sterilizing course for sterilizing clothes.

In addition, the plurality of course selection buttons 97 may include a drying button 97*e* for selecting a drying course for drying clothes, an ironing button 97*f* for selecting an ironing course for ironing clothes, and a special ironing button 97*g* for selecting a special ironing course for ironing a special portion of clothes.

The plurality of course selection buttons 97 as illustrated in FIG. 18 are only one example. When the clothes treatment apparatus 1 is formed to perform a clothes treatment course other than the above-described courses, a selection button for selecting the different clothes treatment course may be provided.

The power button 98 may be configured to turn on/off the clothes treatment apparatus 1. In other words, when the power button 98 is pressed, power is applied to the clothes treatment apparatus 1, so that the user may set an operation condition of the clothes treatment apparatus 1 using the plurality of course selection buttons 97. When the power button 98 is pressed again, the power supplied to the clothes treatment apparatus 1 is turned off.

The operation button 99 may cause the clothes treatment apparatus 1 to perform a clothes treatment course. In other words, when the operation button 99 is pressed, the clothes treatment course selected by the user is performed. When the operation button 99 is pressed while the clothes treatment apparatus 1 is in operation, the operation of the clothes treatment apparatus 1 may be temporarily stopped.

In the above description, the input device 95 is implemented with the plurality of buttons 97, 98, and 99. However, as another example, the input device 95 may be implemented as a touch screen. For example, the plurality of course selection buttons 97, the power button 98, and the operation button 99 may be implemented as software buttons displayed on the touch screen.

The processor 90 may perform control on each component in the clothes treatment apparatus 1. In detail, the processor 90 may control an operation of a component related to a specific function. For example, the processor 90 may control the operation of the injection device 92 when it is necessary to perform the steam function, and may control the operation of the circulation device 93 when it is necessary to perform the drying function.

In the other hand, when performing the ironing course, the processor 90 may control the operations of the injection device 92, the circulation device 93, and the heating plate 31. In addition, the processor 90 may control the operation of the heating member 54 of the holding device 50 or 50' when performing a special ironing course.

The processor 90 may include, for example, a processing circuit such as an electronic circuit board, various electronic components such as ASICs, ROMs, RAMs, and/or program modules. Because the processor 90 for treating clothes by controlling the clothes treatment apparatus 1 is the same as or similar to the processor of the clothes treatment apparatus according to the prior art, a detailed description of the configuration of the processor 90 is omitted.

Hereinafter, a method of treating clothes by a user using the clothes treatment apparatus 1 according to an embodiment of the disclosure will be described in detail with reference to FIG. 19.

Figure 19:
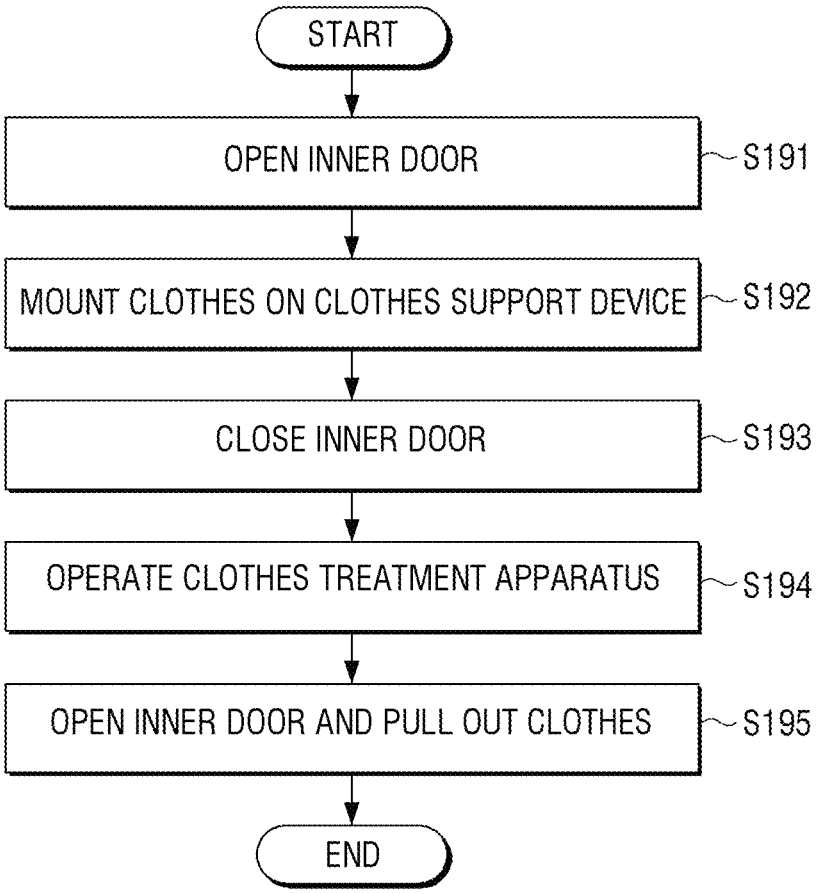
FIG. 19 is a flowchart illustrating a method of performing a treatment other than ironing on clothes by a user with a clothes treatment apparatus according to an embodiment.

FIG. 19 is a flowchart illustrating a method of performing a treatment other than ironing on clothes by a user with a clothes treatment apparatus according to an embodiment.

First, the user opens the inner door 20 to open the accommodation space 11 of the cabinet 10 (S191). At this time, when the user does not operate the fixing lever 41 of the outer door 30, the outer door 30 rotates integrally with the inner door 20. FIG. 3 shows a state in which the inner door 20 of the clothes treatment apparatus 1 is opened.

Subsequently, the user separates the clothes support device 91 provided in the accommodation space 11 of the cabinet 10 and takes it out to the outside, and then mounts clothes on the clothes support device 91 (S192). The clothes support device 91 on which the clothes is mounted is again disposed in the accommodation space 11 of the cabinet 10.

Next, the user closes the inner door 20 to seal the accommodation space 11 of the cabinet 10 (S193). At this time, the outer door 30 rotates integrally with the inner door 20.

Subsequently, the user operates the clothes treatment apparatus 1 (S194). In detail, the user may activate the clothes treatment apparatus 1 by selecting one of the plurality of course selection buttons 97 provided in the input device 95 (see FIG. 18) and pressing the operation button 99.

For example, the user may select the standard course 97*a* and press the operation button 99 to operate the clothes treatment apparatus 1. In this case, the processor 90 may control the injection device 92 and the circulation device 93 to perform a clothes treatment corresponding to the selected clothes treatment course.

When the selected clothes treatment course is completed, the user opens the inner door 20 and pulls out the clothes mounted on the clothes support device 91 (S195).

As described above, the clothes treatment apparatus 1 according to an embodiment of the disclosure may perform the same or similar clothes treatment courses as the conventional clothes treatment apparatus.

Hereinafter, a method of ironing clothes by the user using the clothes treatment apparatus 1 according to an embodiment of the disclosure will be described in detail with reference to FIG. 20.

Figure 20:
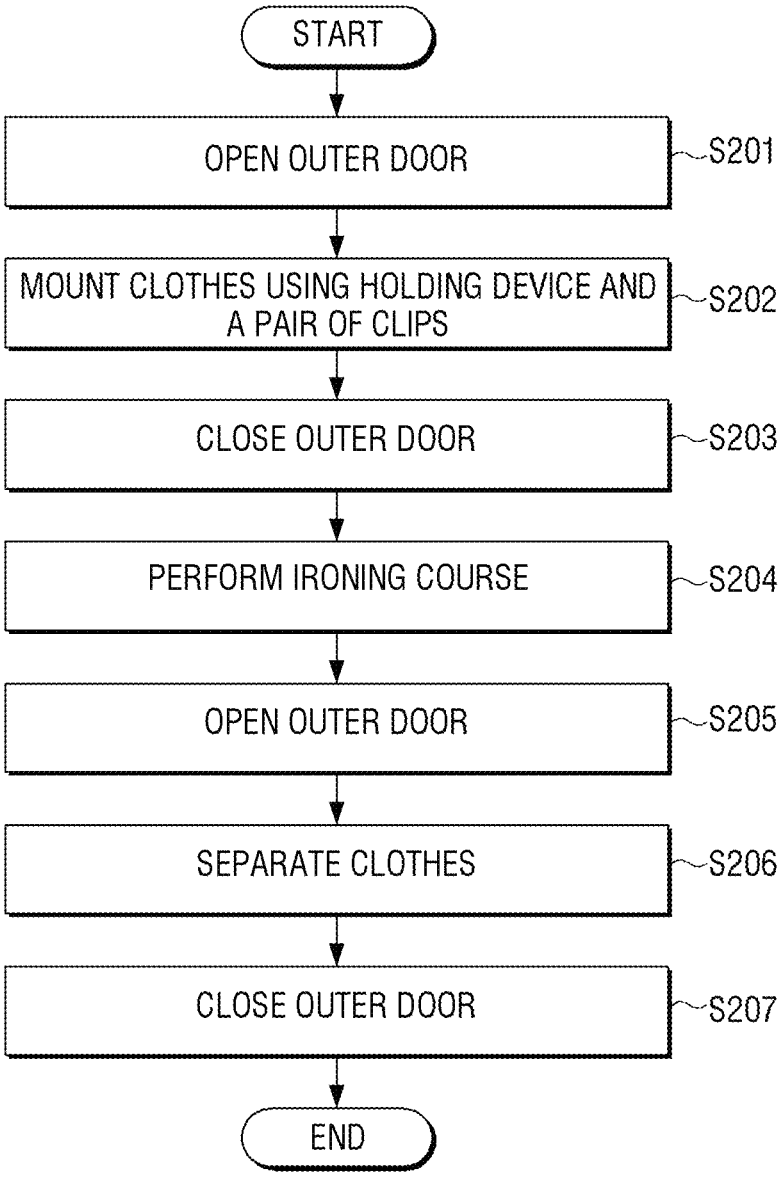
FIG. 20 is a flowchart illustrating a method for a user to iron clothes with a clothes treatment apparatus according to an embodiment.

FIG. 20 is a flowchart illustrating a method of ironing clothes by a user with a clothes treatment apparatus according to an embodiment.

First, the user opens the outer door 30 (S201). At this time, when the user presses the operating part 43 of the fixing lever 41 (see FIG. 5) provided on the outer door 30, the locking part 42 of the fixing lever 41 is removed from the fixing part 45 provided in the inner door 20. Then, the user may open the outer door 30 while the inner door 20 is fixed to cabinet 10 as illustrated in FIG. 2. When the outer door 30 is opened, the front surface of the inner door 20 is exposed to the outside.

Subsequently, the user mounts clothes using the holding device 50 and the pair of clips 85 provided on the inner door 20 (S202). For example, when mounting pants, one end of the pants (originally, the lower end of the pants) is fixed to the holding device 50, and both sides of the pants adjacent to the other end of the pants (originally, the upper end of the pants) are fixed with the pair of clips 85 (see FIG. 16).

At this time, when the user presses the pedal 70 or the foot switch 78 provided in the lower portion of the inner door 20 with her or his foot, the pressing plate 52 of the holding device 50 is opened, so the user may use both hands to position the one end of the pants on the holding device 50. In this state, when the user releases his or her foot from the pedal 70 or the foot switch 78, the pressing plate 52 returns to its original position to fix the one end of the pants.

Therefore, the user may pivot the pressing plate 52 of the holding device 50 by manipulating the pedal 70 or the foot switch 78 with a foot, so that the user may easily fix the one end of the pants to the holding device 50 with both hands.

Next, when the mounting of the clothes on the inner door 20 is completed, the user closes the outer door 30 (S203). When the outer door 30 is closed, the locking part 42 of the fixing lever 41 is caught by the locking jaw 47 of the fixing part 45 of the inner door 20, so that the outer door 30 is fixed to the inner door 20.

Subsequently, the user performs an ironing course (S204). In detail, the user operates the clothes treatment apparatus 1 by pressing the ironing button 97*f* for selecting the ironing course in the input device 95 and pressing the operation button 99.

Then, the processor 90 controls the clothes treatment apparatus 1, thereby performing the ironing course.

Hereinafter, a control method in which the processor 90 performs the ironing course by controlling the clothes treatment apparatus 1 will be described in detail with reference to FIG. 21.

Figure 21:
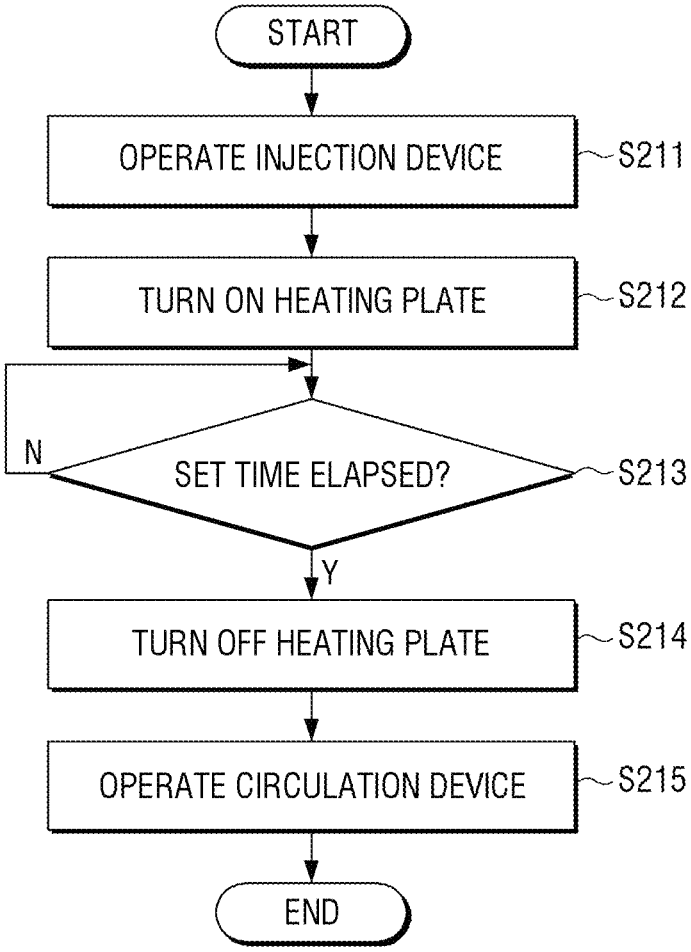
FIG. 21 is a flowchart illustrating a control method of performing an ironing course by a clothes treatment apparatus according to an embodiment.

FIG. 21 is a flowchart illustrating a control method of performing an ironing course by a clothes treatment apparatus according to an embodiment.

When a signal is input by pressing the ironing button 97*f* and the operation button 99, the processor 90 performs the ironing course.

First, the processor 90 operates the injection device 92 (S211) to supply high-temperature steam to the accommodation space 11 of the cabinet 10. The steam generated by the injection device 92 is supplied to clothes mounted in the space 33 between the inner door 20 and the outer door 30 through the opening 21 of the inner door 20. The high-temperature steam may change the fabric structure of the clothes mounted in the space 33 between the inner door 20 and the outer door 30 into a flexible state.

Subsequently, the processor 90 turns on the heating plate 31 provided on the rear surface of the outer door 30 (S212). In other words, the processor 90 applies power to the heating plate 31 so that the heating plate 31 is heated. When the heating plate 31 is heated, ironing is performed on the clothes mounted in the space 33 between the inner door 20 and the outer door 30.

After supplying power to the heating plate 31, the processor 90 determines whether a set time has elapsed (S213). The set time may be appropriately determined so that appropriate ironing may be performed for the clothes mounted in the space 33 between the inner door 20 and the outer door 30.

When the set time has elapsed, the processor 90 turns off the heating plate 31 (S214). In other words, the processor 90 cuts off power being supplied to the heating plate 31.

Subsequently, the processor 90 operates the circulation device 93 (S215), thereby drying the clothes mounted in the accommodation space 11 of the cabinet 10 and the space 33 between the inner door 20 and the outer door 30. In other words, the circulation device 93 operated by the processor 90 circulates high-temperature air in the accommodation space 11 of the cabinet 10. Then, the high-temperature air is supplied to the clothes mounted in the space 33 between the inner door 20 and the outer door 30 through the opening 21 of the inner door 20, so that the ironed clothes may be dried.

When the ironing course is completed, the user operates the fixing lever 41 to open the outer door 30 (S205). Then, the clothes mounted on the front surface of the inner door 20 is exposed.

Then, the user separates the clothes from the holding device 50 and the pair of clips 85 (S206).

Finally, when the user closes the outer door 30 (S207), the ironing of the clothes is completed.

Hereinafter, another example of a method for a user to iron clothes by using a clothes treatment apparatus 1 according to an embodiment of the disclosure will be described in detail with reference to FIG. 22.

Figure 22:
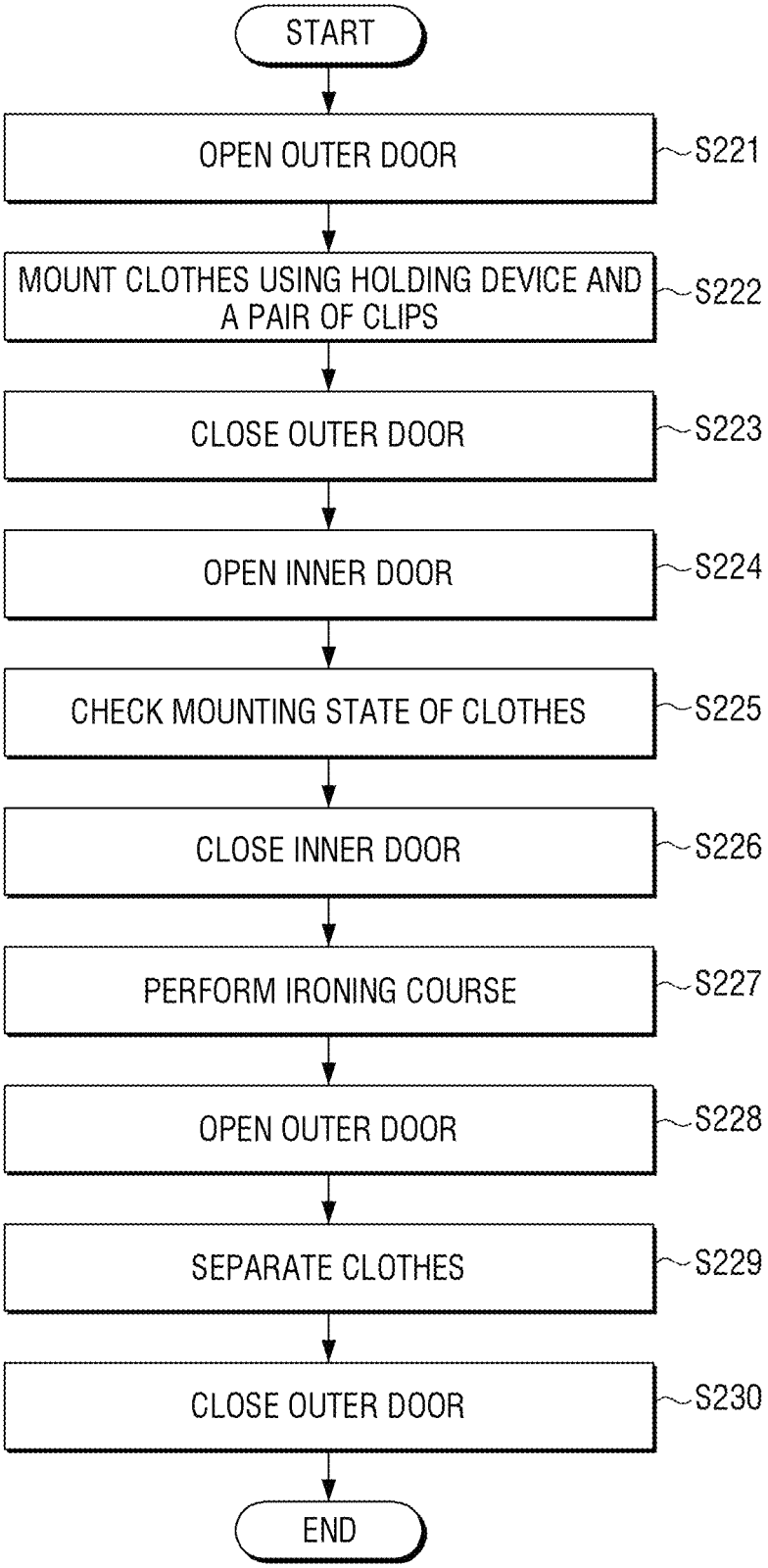
FIG. 22 is a flowchart illustrating another example of a method for a user to iron clothes with a clothes treatment apparatus according to an embodiment.

FIG. 22 is a flowchart illustrating another example of a method for a user to iron clothes with a clothes treatment apparatus according to an embodiment.

Referring to FIG. 22, the processes of opening the outer door 30, mounting clothes in the space 33 between the inner door 20 and the outer door 30, and closing the outer door 30 (S221, S222, and S223) are the same as the above-described processes S201, S202, and S203 of FIG. 20. Therefore, detailed descriptions thereof are omitted.

After closing the outer door 30, the user opens the inner door 20 (S224). At this time, when the outer door 30 is closed, the locking part 42 of the fixing lever 41 of the outer door 30 is caught by the locking jaw 47 of the fixing part 45 of the inner door 20. Therefore, when the inner door 20 is opened, the outer door 30 also rotates integrally with the inner door 20.

After opening the inner door 20, the user checks the state in which the clothes is mounted in the space 33 between the inner door 20 and the outer door 30 through the transparent window 24 of the inner door 20 (S225). When the clothes are normally mounted, the user closes the inner door 20 (S226).

When the clothes are mounted abnormally, the user operates the fixing lever 41 of the outer door 30 to separate the inner door 20 from the outer door 30. Then, the user may correct the mounting state of the clothes mounted on the inner door 20. When the correction of the mounting state is completed, the user connects the outer door 30 and the inner door 20 using the fixing lever 41, and then checks the mounting state of the clothes through the transparent window 24 again. When the clothes are normally mounted, the user closes the inner door 20.

Subsequently, the user causes the clothes treatment apparatus 1 to perform an ironing course (S227). The method of performing the ironing course by the clothes treatment apparatus 1 is the same as the control method of FIG. 21 described above; therefore, a detailed description thereof is omitted.

After the ironing course is completed, the processes of separating the clothes S228, S229, and S230 are the same as the processes S205, S206, and S207 of FIG. 20 as described above; therefore, detailed descriptions thereof are omitted.

When ironing is performed after checking the mounting state of the clothes mounted in the space 33 between the inner door 20 and the outer door 30 as in the method shown in FIG. 22, poor ironing due to incorrect mounting of clothes may be prevented.

The clothes treatment apparatus 1 according to an embodiment of the disclosure may perform ironing on a special portion of clothes that may not be ironed by mounting the clothes in the space 33 between the inner door 20 and the outer door 30 in a separate method.

Figure 23:
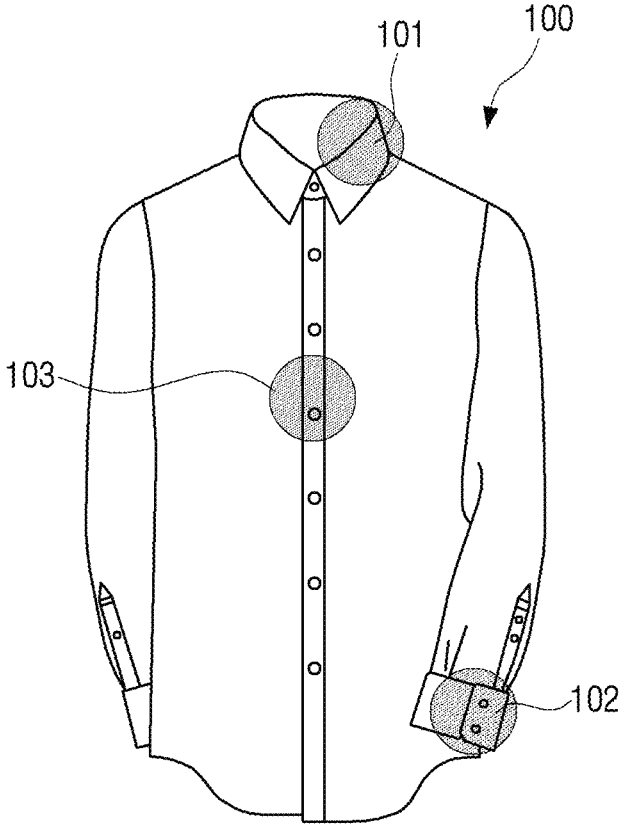
FIG. 23 is a view illustrating special portions of clothes that may be ironed by a clothes treatment apparatus according to an embodiment.

Here, the special portion of the clothes refers to a portion of the clothes that cannot be ironed using the above-described ironing course. For example, the special portion of the clothes refers to the collars 101, the cuffs 102, and the button portions 103 of the shirt 100, as illustrated in FIG. 23. For reference, FIG. 23 is a view illustrating special portions of clothes that may be ironed by a clothes treatment apparatus according to an embodiment.

However, the special portions of the shirt 100 as illustrated in FIG. 23 are only an example of portions that may be ironed by the clothes treatment apparatus 1 according to an embodiment of the disclosure, and the disclosure is not limited thereto. The clothes treatment apparatus 1 according to the disclosure may perform ironing on various portions of various clothes that require partial ironing.

Hereinafter, a method of ironing a special portion of clothes using the clothes treatment apparatus 1 according to an embodiment of the disclosure will be described in detail with reference to FIGS. 24 and 25.

Figure 24:
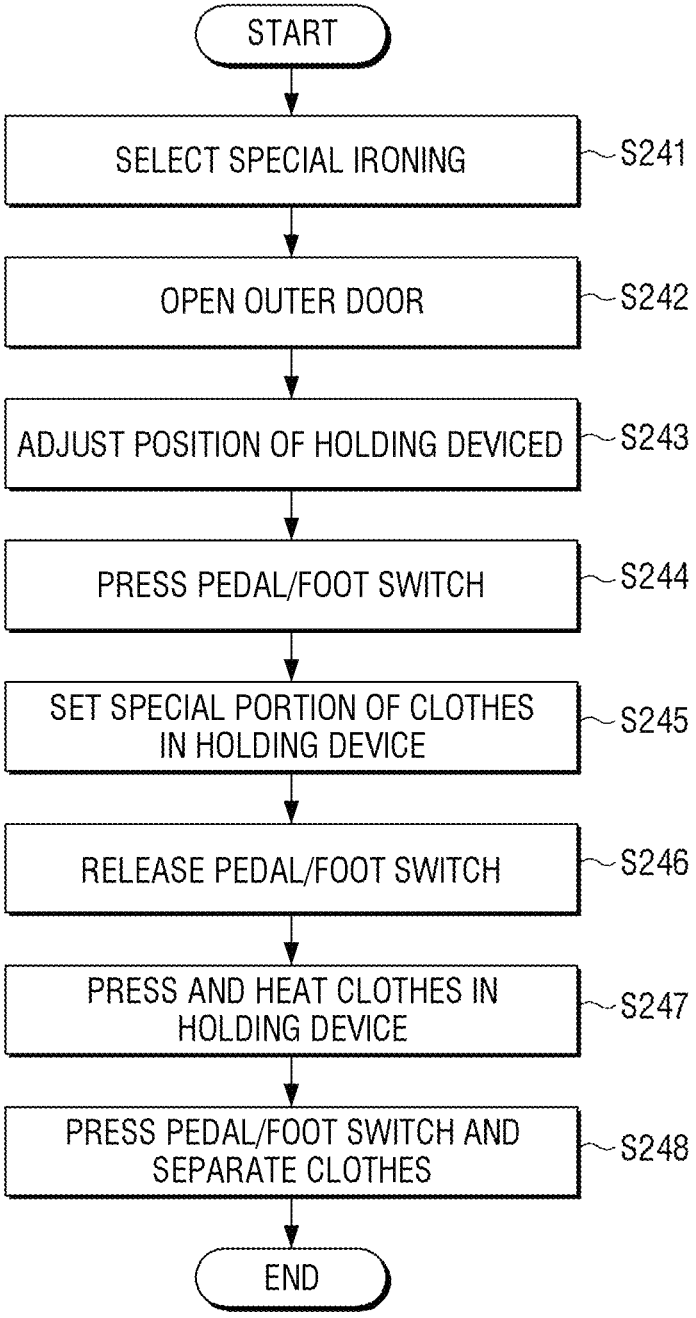
FIG. 24 is a flowchart illustrating a method for a user to iron a special portion of clothes with a clothes treatment apparatus according to an embodiment.
Figure 25:
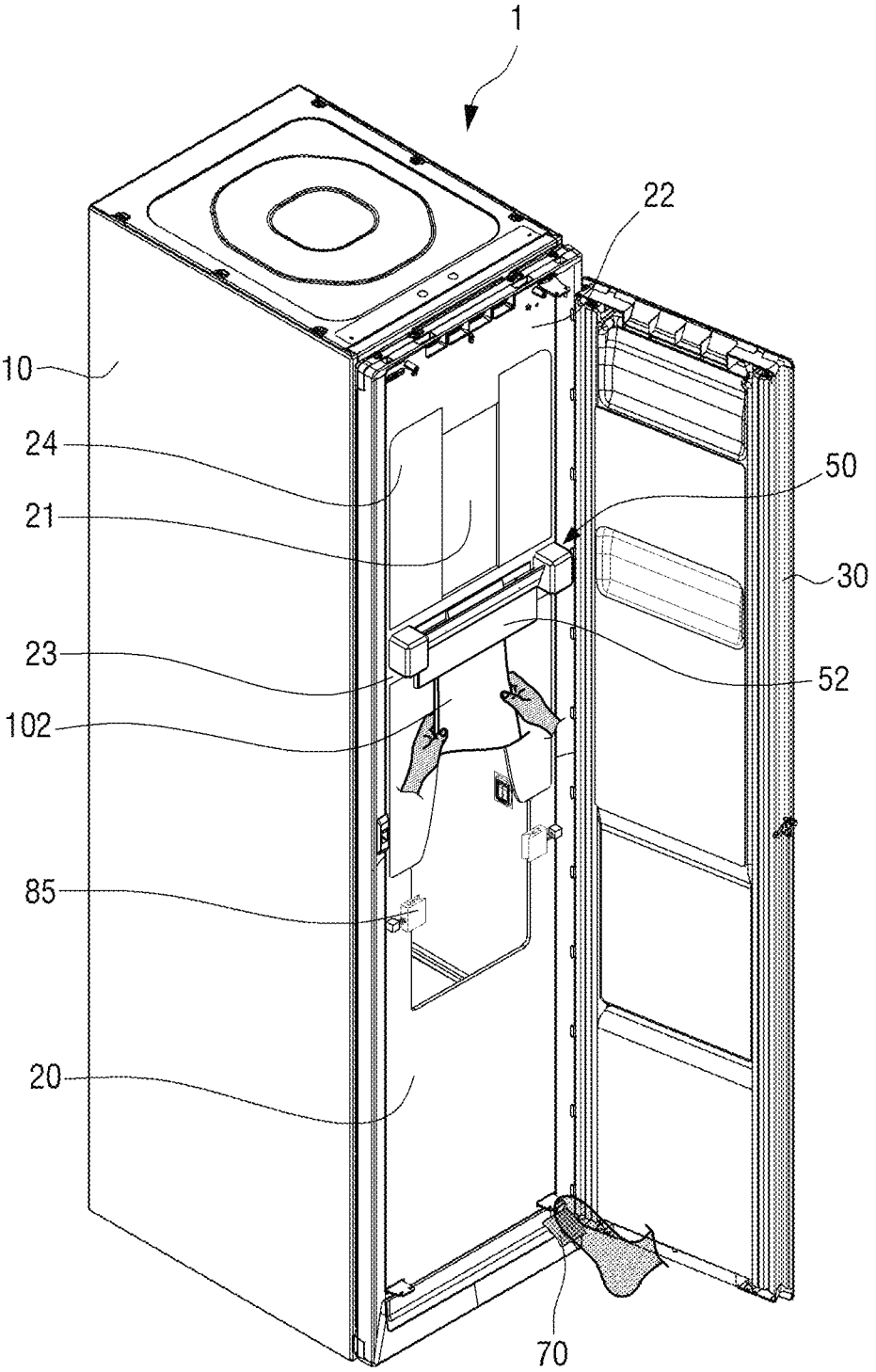
FIG. 25 is a view illustrating a state in which a user irons a cuff of a shirt with a holding device of a clothes treatment apparatus according to an embodiment.

FIG. 24 is a flowchart illustrating a method for a user to iron a special portion of clothes using a clothes treatment apparatus according to an embodiment. FIG. 25 is a view illustrating a state in which a user irons a cuff of a shirt by using a holding device of a clothes treatment apparatus according to an embodiment.

First, the user selects a special ironing (S241). For example, the user may select the special ironing by pressing the special ironing button 97*g* in the input device 95 of FIG. 18.

Subsequently, the user opens the outer door 30 (S242). At this time, when the user operates the fixing lever 41 of the outer door 30, the outer door 30 may be opened while the inner door 20 is fixed to the cabinet 10. Then, the front surface of the inner door 20 is exposed to the outside.

Next, the user adjusts the position of the holding device 50 (S243). For example, when the holding device 50 is located on the upper end of the inner door 20, that is, the first holder mounting portion 22, the user moves the holding device 50 to the second holder mounting portion 23. When the holding device 50 is located on the second holder mounting portion 23, it may be easy for the user to place the special portion of the clothes on the holding device 50. When the holding device 50 is located on the second holder mounting portion 23, the user may not move the holding device 50.

Subsequently, the user presses the pedal 70 or the foot switch 78 using the foot (S244). Then, the pressing plate 52 of the holding device 50 rotates to form a gap between the front surface of the inner door 20 and the pressing plate 52.

The user sets the special portion 102 of the clothes 100 under the holding device 50, that is, the pressing plate 52 (S245). FIG. 25 illustrates a state in which the cuff 102 of the shirt 100 is set under the pressing plate 52 of the holding device 50.

In the state in which the special portion 102 of the clothes is set in the holding device 50, the user takes off the foot from the pedal 70 or the foot switch 78 (S246). Then, the pressing plate 52 of the holding device 50 returns to its original position, thereby pressing the special portion 102 of the clothes 100. At this time, power is applied to the heating member 54 provided in the pressing plate 52 to heat the pressing plate 52 (S247). Therefore, because the special portion 102 of the clothes 100 is pressed by the pressing plate 52 and heated by the heat generated by the heating member 54 at the same time, ironing may be effectively performed.

When the ironing of the special portion 102 of the clothes 100 is completed, the user presses the pedal 70 or the foot switch 78 again to rotate the pressing plate 52 of the holding device 50, thereby separating the special portion 102 of the clothes 100 ironed by the pressing plate 52 (S248).

When the special ironing button 97*g* is pressed in the input device 95, the processor 90 may be configured to turn on or off the heating member 54 of the pressing plate 52 according to the operation of the pedal 70 or the foot switch 78. At this time, the processor 90 may be configured so as not to operate other components of the clothes treatment apparatus 1 other than the holding device 50.

With the clothes treatment apparatus 1 according to an embodiment of the disclosure as described above, ironing may be performed on clothes mounted in the space 33 between the inner door 20 and the outer door 30. Therefore, when clothes have original creases, such as pants, the creases may be sharpened to maintain the knife edge creases.

In addition, with the clothes treatment apparatus 1 according to an embodiment of the disclosure, a special portion of clothes that may not be ironed while mounted in a space 33 between the inner door 20 and the outer door 30 may be ironed using the holding device 50.

According to the clothes treatment apparatus according to an embodiment of the disclosure having the above-described structure and a control method thereof, because ironing may be performed on clothes mounted in the space between the inner door and the outer door, the original creases of the clothes, such as the creases of the pants may be sharpened like the knife edge creases.

In addition, with the clothes treatment apparatus according to an embodiment of the disclosure and a control method thereof, special portions of clothes that may not be ironed while mounted in a space between the inner door and the outer door may be ironed easily.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes treatment apparatus comprising:

a cabinet including an accommodation space;

an inner door disposed to be rotatable in a front surface of the cabinet to open and close the accommodation space and provided with an opening;

an outer door disposed to form a space in which clothes are mounted between a front surface of the inner door and the outer door, the outer door disposed to rotate with respect to the cabinet together with the inner door or with respect to the inner door separately from the inner door in a state that the inner door is fixed to the cabinet and closes the accommodation space;

a heating plate disposed on a rear surface of the outer door;

a holding device disposed in an upper portion of the space between the inner door and the outer door and formed to hold one end of the clothes; and a pair of clips disposed under the holding device in the space between the inner door and the outer door and formed to hold both sides of the clothes.

2. The clothes treatment apparatus as claimed in claim 1, wherein:

the inner door comprises a plurality of holder mounting portions on which the holding device is disposed, and the plurality of holder mounting portions are provided at a predetermined interval in a vertical direction on the front surface of the inner door.

3. The clothes treatment apparatus as claimed in claim 1, wherein the holding device comprises:

a base plate disposed on the front surface of the inner door; and a pressing plate hinged to be pivotable with respect to the base plate and configured to apply a force toward the front surface of the inner door.

4. The clothes treatment apparatus as claimed in claim 3, wherein the holding device further comprises a heating member disposed on an inner surface of the pressing plate.

5. The clothes treatment apparatus as claimed in claim 3, wherein:

the holding device further comprises a pedal disposed in a lower portion of the inner door and formed to rotate the pressing plate, when a force is applied to the pedal, the pressing plate is configured to rotate in a direction away from the inner door, and when the force applied to the pedal is removed, the pressing plate is configured to apply a predetermined force toward the inner door.

6. The clothes treatment apparatus as claimed in claim 5, wherein the holding device further comprises:

a pressing member disposed between the base plate and the pressing plate and configured to press the pressing plate toward the inner door;

a drive part disposed on one side of the pressing plate and configured to rotate the pressing plate;

a wire connecting the pedal and the drive part; and a restoring elastic member disposed on the pedal and configured to return the pedal to its original position.

7. The clothes treatment apparatus as claimed in claim 3, wherein the holding device further comprises:

a pressing member disposed between the base plate and the pressing plate and configured to press the pressing plate toward the inner door;

a motor disposed on one side of the pressing plate and configured to rotate the pressing plate in a direction spaced apart from the inner door; and a foot switch disposed in a lower portion of the inner door and configured to turn the motor on and off.

8. The clothes treatment apparatus as claimed in claim 7, wherein:

when a force is applied to the foot switch, the motor is configured to rotate in one direction so that the pressing plate is spaced apart from the inner door, and when the force applied to the foot switch is removed, the pressing member is configured to press the pressing plate toward the inner door.

9. The clothes treatment apparatus as claimed in claim 1, wherein:

each of the pair of clips comprises a shape memory alloy spring, and when a temperature inside the cabinet increases, the shape memory alloy spring is configured to contract to pull the clothes.

10. The clothes treatment apparatus as claimed in claim 1, further comprising at least one lower clip disposed in the space between the inner door and the outer door and formed to pull down the clothes.

11. The clothes treatment apparatus as claimed in claim 1, wherein the inner door includes transparent windows provided on both sides of the opening.

12. The clothes treatment apparatus as claimed in claim 11, wherein the opening is formed in a shape corresponding to a contour of pants.

13. The clothes treatment apparatus as claimed in claim 1, further comprising:

a fixing lever disposed in the outer door and provided with a locking part at one end thereof and an operating part at another end thereof; and a fixing part provided in the inner door and formed to catch the locking part of the fixing lever, wherein when the operating part of the fixing lever is pressed, the locking part of the fixing lever is removed from the fixing part and the outer door is rotated separately from the inner door.

14. The clothes treatment apparatus as claimed in claim 1, further comprising an elastic member disposed between the heating plate and the rear surface of the outer door and elastically supporting the heating plate toward the inner door.

15. A control method of a clothes treatment apparatus, the control method comprising:

mounting clothes in a space between an inner door and an outer door of the clothes treatment apparatus by opening the outer door in a state that the inner door is fixed to a cabinet of the clothes treatment apparatus; and performing ironing on the clothes by the clothes treatment apparatus, wherein the performing ironing on the clothes comprises:

generating steam by operating an injection device, supplying the steam to the clothes, generating heat by a heating plate of the outer door, and drying the clothes by operating a circulation device.

16. The control method as claimed in claim 15, wherein the mounting the clothes in the space between the inner door and the outer door of the clothes treatment apparatus further comprises:

fixing one end of the clothes with a holding device of the inner door and fixing two sides of the clothes with a pair of clips; and closing the outer door.

17. The control method as claimed in claim 16, wherein:

the holding device comprises a pedal disposed in a lower portion of the inner door, and in response to the pedal being pressed, a pressing plate of the holding device is configured to open so that the one end of the clothes is able to be placed under the pressing plate, and in response to the pedal being released, the pressing plate of the holding device is configured to press the one end of the clothes.

18. The control method as claimed in claim 16, wherein:

the holding device comprises a foot switch disposed in a lower portion of the inner door, and in response to the foot switch being pressed, a pressing plate of the holding device is configured to open so that the one end of the clothes is able to be placed under the pressing plate, and in response to the foot switch being released, the pressing plate of the holding device is configured to press the one end of the clothes.

19. A control method of a clothes treatment apparatus, the control method comprising:

selecting a special ironing in the clothes treatment apparatus;

opening an outer door of the clothes treatment apparatus;

checking a position of a holding device disposed in an inner door and adjusting the position of the holding device;

pressing a pedal or a foot switch so that a pressing plate of the holding device is opened;

setting a special portion of clothes in the holding device;

releasing the pedal or the foot switch;

applying force and heat to the special portion of the clothes by the holding device; and pressing the pedal or the foot switch and removing the clothes from the holding device.

20. The control method as claimed in claim 19, wherein:

the holding device comprises a heating member, and the heating member is configured to be turned on and off by the pedal or the foot switch.

* * * * *